US009928943B1

(12) United States Patent
McNutt et al.

(10) Patent No.: US 9,928,943 B1
(45) Date of Patent: Mar. 27, 2018

(54) COMMUNICATION CABLES INCORPORATING SEPARATOR STRUCTURES

(71) Applicant: Superior Essex International LP, Atlanta, GA (US)

(72) Inventors: Christopher W. McNutt, Woodstock, GA (US); Amir Sekhavat, Marietta, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 15/227,365

(22) Filed: Aug. 3, 2016

(51) Int. Cl.

| | |
|---|---|
| ***H01B 7/00*** | (2006.01) |
| ***H01B 11/10*** | (2006.01) |
| ***H01B 11/00*** | (2006.01) |
| ***H01B 11/04*** | (2006.01) |

(52) U.S. Cl.
CPC ..... *H01B 11/1008* (2013.01); *H01B 11/002* (2013.01); *H01B 11/005* (2013.01); *H01B 11/04* (2013.01); *H01B 11/1016* (2013.01)

(58) Field of Classification Search
CPC ... H01B 7/02; H01B 7/04; H01B 7/08; H01B 9/02; H01B 9/04; H01B 11/002; H01B 11/005; H01B 11/02; H01B 11/04; H01B 11/08; H01B 11/10; H01B 11/12
USPC ..... 174/110 R, 113 R, 113 C, 115, 116
See application file for complete search history.

(56) References Cited

U.S. PATENT DOCUMENTS

| | | | | |
|---|---|---|---|---|
| 2,538,019 A | | 1/1951 | Edwin | |
| 2,796,463 A | | 6/1957 | Mallindrodt | |
| 3,090,825 A | | 5/1963 | Volk | |
| 3,135,935 A | | 6/1964 | Eugelbrecht | |
| 3,312,774 A | | 4/1967 | Drinko | |
| 3,373,475 A | | 3/1968 | Peterson | |
| 3,612,744 A | | 10/1971 | Thomas | |
| 4,165,442 A | * | 8/1979 | Gabriel | H01B 11/1016 174/105 B |
| 4,604,497 A | | 8/1986 | Bell et al. | |
| 4,638,272 A | | 1/1987 | Ive | |
| 4,746,767 A | | 5/1988 | Gruhn | |
| 4,881,642 A | | 11/1989 | Adam | |

(Continued)

FOREIGN PATENT DOCUMENTS

| | | | | |
|---|---|---|---|---|
| EP | 0915486 A | * | 11/1998 | H01B 11/08 |
| EP | 1632957 A | * | 5/2005 | H01B 11/08 |

(Continued)

OTHER PUBLICATIONS

"Product Catalogue" 2 pages, Enterprise Cabling R&M, May 2006.

(Continued)

*Primary Examiner* — William H Mayo, III

(57) ABSTRACT

A cable may include a plurality of twisted pairs of individually insulated conductors and a separator positioned between the plurality of twisted pairs. The separator may include a first longitudinally extending tape structure having a first longitudinal fold formed between its widthwise edges and a second longitudinally extending tape structure having a second longitudinal fold formed between its widthwise edges. Additionally, the first tape structure and the second tape structure may be bonded together along a longitudinally extending line proximate to the first and second longitudinal folds. A jacket may be formed around the plurality of twisted pairs and the separator.

20 Claims, 14 Drawing Sheets

(56) References Cited

U.S. PATENT DOCUMENTS

| | | | | |
|---|---|---|---|---|
| 5,006,806 | A | 4/1991 | Rippingale et al. | |
| 5,008,489 | A | 4/1991 | Weeks et al. | |
| 5,106,175 | A | 4/1992 | Davis et al. | |
| 5,114,517 | A | 5/1992 | Rippingale et al. | |
| 5,952,615 | A | 9/1999 | Prudhon | |
| 5,956,445 | A | 9/1999 | Deitz et al. | |
| 6,222,130 | B1 | 4/2001 | Gareis | |
| 6,288,340 | B1 * | 9/2001 | Arnould | H01B 13/2673 174/113 R |
| 6,297,454 | B1 | 10/2001 | Gareis | |
| 6,310,295 | B1 * | 10/2001 | Despard | H01B 11/08 174/113 C |
| 6,506,976 | B1 | 1/2003 | Neveux, Jr. | |
| 6,570,095 | B2 * | 5/2003 | Clark | H01B 11/04 174/113 C |
| 6,624,359 | B2 * | 9/2003 | Bahlmann | H01B 11/06 174/113 C |
| 6,639,152 | B2 | 10/2003 | Glew | |
| 6,687,437 | B1 | 2/2004 | Starnes et al. | |
| 6,723,925 | B2 | 4/2004 | Ohara et al. | |
| 6,737,574 | B2 | 5/2004 | Sylva et al. | |
| 6,770,819 | B2 | 8/2004 | Patel | |
| 6,812,408 | B2 * | 11/2004 | Clark | H01B 11/04 174/113 C |
| 6,850,161 | B1 | 2/2005 | Elliot | |
| 6,888,070 | B1 | 5/2005 | Prescott | |
| 7,098,405 | B2 | 8/2006 | Glew | |
| 7,173,189 | B1 | 2/2007 | Hazy et al. | |
| 7,179,999 | B2 | 2/2007 | Clark et al. | |
| 7,196,271 | B2 * | 3/2007 | Cornibert | H01B 11/06 174/113 C |
| 7,329,815 | B2 | 2/2008 | Kenny et al. | |
| 7,332,676 | B2 | 2/2008 | Sparrowhawk | |
| 7,335,837 | B2 * | 2/2008 | Pfeiler | H01B 11/1008 174/113 C |
| 7,834,271 | B2 * | 11/2010 | Gromko | H01B 11/085 174/113 AS |
| 7,923,632 | B2 | 4/2011 | Smith et al. | |
| 8,119,907 | B1 | 2/2012 | McNutt | |
| 8,313,346 | B2 * | 11/2012 | Sparrowhawk | H01B 11/06 174/113 C |
| 8,445,787 | B2 * | 5/2013 | Nordin | H01B 11/085 174/110 R |
| 8,558,115 | B2 | 10/2013 | Jenner et al. | |
| 9,136,043 | B2 * | 9/2015 | Brown | H01B 11/06 |
| 2003/0111241 | A1 * | 6/2003 | Bahlmann | H01B 11/06 174/367 |
| 2003/0217863 | A1 | 11/2003 | Clark et al. | |
| 2003/0230427 | A1 | 12/2003 | Gareis | |
| 2004/0035603 | A1 * | 2/2004 | Clark | H01B 11/04 174/113 R |
| 2005/0048961 | A1 | 3/2005 | Ribaudo et al. | |
| 2006/0131057 | A1 | 6/2006 | Lique | |
| 2007/0037419 | A1 | 2/2007 | Sparrowhawk | |
| 2007/0044995 | A1 | 3/2007 | Park | |
| 2007/0193769 | A1 | 8/2007 | Clark | |
| 2007/0224495 | A1 | 9/2007 | Gibbons et al. | |
| 2007/0275583 | A1 * | 11/2007 | McNutt | H01B 11/06 439/225 |
| 2008/0255435 | A1 | 10/2008 | Al-Ali et al. | |
| 2008/0264670 | A1 | 10/2008 | Glew | |
| 2008/0314636 | A1 | 12/2008 | Ogura | |
| 2011/0147039 | A1 | 6/2011 | Smith et al. | |
| 2013/0008684 | A1 | 1/2013 | Weitzel | |

FOREIGN PATENT DOCUMENTS

| | | | |
|---|---|---|---|
| GB | 2432963 | 6/2007 | |
| JP | 2000090748 | 3/2000 | |
| JP | 2004311120 | 11/2004 | |
| JP | 2006173044 | 6/2006 | |
| WO | WO2006105166 | 5/2006 | |
| WO | WO2011/020967 A * | 2/2011 | H01B 11/04 |

OTHER PUBLICATIONS

"Draka" 12 pages, Draka Comtez, Cable Solutions, Data Cables, Sep. 27, 2006.
"10 Gigabit Ethernet Solutions" 8 pages, R&M Convincing Cabling Solultions.
WETZIKON, "R&M: The Rising Stars in Cooper Cabling" 2 pages, Sep. 1, 2005.
"R&M Star Real 10" 2 pages, Mar. 2006.
"Connections 29"36 pages, Sep. 2005.
Pfeiler et al., U.S. Pat. No. 7,335,837, issued Feb. 26, 2008.
Non-Final Office Action for U.S. Appl. No. 15/227,390, dated Aug. 30. 2017.
Non-Final Office Action for U.S. Appl. No. 15/345,775, dated Jun. 26, 2017.
Notice of Allowance for U.S. Appl. No. 15/455,182, dated Jun. 28, 2017.
Notice of Allowance for U.S. Appl. No. 15/435,685, dated Aug. 10, 2017.

* cited by examiner

COMMUNICATION CABLES INCORPORATING SEPARATOR STRUCTURES

CROSS-REFERENCES TO RELATED APPLICATIONS

This application is related to pending U.S. patent application Ser. No. 15/227,390, filed Aug. 3, 2016 and entitled "Communication Cables Incorporating Separator Structures that Function as Shields", the contents of which is incorporated herein by reference in its entirety.

TECHNICAL FIELD

Embodiments of the disclosure relate generally to communication cables and, more particularly, to communication cables that incorporate separator structures positioned between twisted pairs and that optionally function as shields for the twisted pairs.

BACKGROUND

A wide variety of different types of cables are utilized to transmit power and/or communications signals. In certain types of cables, it is desirable to separate internal cable components. For example, certain cables make use of multiple twisted pairs to communicate signals. In each pair, the wires are twisted together in a helical fashion to form a balanced transmission line. When twisted pairs are placed in close proximity, such as within the core of a cable, electrical energy may be transferred from one pair of the cable to another pair. Such energy transfer between pairs is undesirable and is referred to as crosstalk. Crosstalk causes interference to the information being transmitted through the twisted pairs and can reduce the data transmission rate and can cause an increase in bit rate error. Interlinking typically occurs when two adjacent twisted pairs are pressed together filling any interstitial spaces, and interlinking can lead to an increase in crosstalk among the wires of adjacent twisted pairs.

In order to improve crosstalk performance, a filler, interior support, or spline has been inserted into many conventional cables. These fillers serve to separate adjacent twisted pair cables and prevent interlinking of twisted pairs. Certain convention fillers, such as conventional fillers having a cross-shaped cross-section, are formed via an extrusion process. However, the extrusion process often leads to discrepancies in the thickness of the filler. For example, an extruded filler intended to have a cross-shape may have more of a diamond-shaped cross-section due to extruded material collecting in bends and corners. Additionally, the formation and incorporation of extruded fillers may be more expensive than other types of fillers, such as tape fillers.

As an alternative to extruding a cross filler, certain conventional fillers have been formed by folding a tape into a structure having a cross-shape. For example, U.S. Pat. No. 7,335,837 to Pfeiler et al describes a multi-layer screening sheet that can be folded into a cross filler. However, the formation of cross filler from a single tape requires a large number of folds which often leads to non-uniform dimensions. Additionally, a single tape cross filler must necessarily be folded over itself at several locations, leading to increased thicknesses and material costs. Accordingly, there is an opportunity for improved fillers or separators for use in cables.

Additionally, in many cables, shields are incorporated in order to further mitigate the effects of noise, interference, and crosstalk. For example, an overall shield can be formed around a plurality of twisted pair conductors. However, shields and fillers are typically formed as separate components, requiring additional processing steps. Accordingly, there is an opportunity for improved fillers or separators that may further function as shields.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1A:
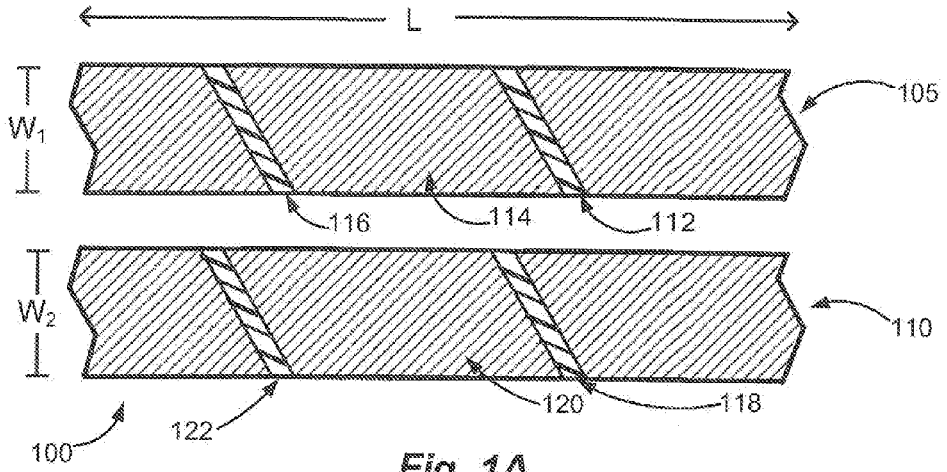
FIGS. 1A-C respectively illustrate top level, side, and cross-sectional views of two example tape structures that may be utilized to form a separator structure, according to an illustrative embodiment of the disclosure.

Various embodiments of the present disclosure are directed to separator structures that may be incorporated into communication cables, and to cables incorporating the separator structures. In certain embodiments, a separator structure, separator, or filler may be incorporated into a cable or a cable component that includes a plurality of twisted pairs of individually insulated conductors. The separator may be positioned between two or more of the twisted pairs, and the separator may assist in orienting the twisted pairs and/or maintaining the positions of the twisted pairs. In certain embodiments, the separator may also include shielding material that is positioned between two or more of the twisted pairs in order to improve electrical performance, for example, by reducing cross-talk, interference, and/or noise.

According to an aspect of the disclosure, a separator may be formed from two tape structures. Each tape structure may be an elongated structure that is relatively flat. In other words, each tape structure may have a thickness that is substantially less than its width and longitudinal length. In certain embodiments, a tape structure may be formed as a strip or sheet type of structure. As desired in certain embodiments, a tape structure may have a substantially uniform thickness. Each tape structure may be formed from a wide variety of suitable materials and/or combinations of materials. For example, in certain embodiments, a tape structure may be formed from one or more dielectric layers with one or more layers of shielding material (e.g., electrically conductive material, etc.) bonded, adhered, affixed, joined, or otherwise combined with the dielectric layer(s).

In order to form a separator, each of the tape structures may be folded along its longitudinal length, and the two tape structures may be positioned adjacent to one another. For example, an approximately ninety degree (90°) fold may be formed in each tape structure, and the two tape structures may be arranged such that the combination forms a separator with an approximately cross-shaped cross-section. In other words, at a cross-sectional point taken along a longitudinal length of the separator, the first tape structure may extend from its longitudinal fold in two directions that form two prongs or extensions of a cross, and the second tape structure may extend from its longitudinal fold in two directions that form the remaining two prongs or extension of the cross. In an example cable, a respective twisted pair of conductors may be positioned in each of the cavities or channels formed by the prongs.

Additionally, in certain embodiments, the two tape structures may be positioned such that their respective folds are proximate or adjacent to one another. For example, the two folds may be positioned approximately at a cross-sectional center point of the separator from which the prongs extend. In certain embodiments, the two tape structures may be longitudinally bonded together at or near their respective folds. For example, the tape structures may be bonded together along a longitudinally extending line (or at various points along a longitudinally extending line) that is proximate to the respective folds formed in the two tape structures.

As set forth above, shielding material may be incorporated into a separator structure. For example, one or both of the tape structures utilized to form the separator may include electrically conductive, semi-conductive, or other material that provides for electromagnetic shielding. In certain embodiments, one or more prongs or extensions of the separator may extend beyond an outer periphery of twisted pairs (or other cable components) that are arranged or positioned proximate to the separator. In other words, one or more longitudinally extending widthwise edges of either one or both tape structures may extend beyond an outer periphery of the twisted pairs. The extending tape portion(s) may then be curled, wrapped, or folded around the outer periphery of the twisted pairs. In this regard, a complete (or partial) outer wrap or external layer may be formed around the twisted pairs. For example, an outer or external shield layer may be formed by one or more extending tape portions.

As a result of forming a separator from two longitudinally folded tapes, a separator structure may be formed that is relatively less expensive than conventional extruded separators. Additionally, the dual-tape separator may have a relatively uniform thickness. By contrast, when certain conventional separators are formed from individual tape, the tape must be folded over itself at multiple locations, leading to discontinuities in its thickness and likely resulting in manufacturing difficulties.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Example Separator Structures

FIGS. 1A-8E illustrate a few example separator structures and tape structures that may be utilized to form the separator structures. In particular, FIGS. 1A-E illustrate a first example separator structure that may be formed from two tape structures. FIGS. 2A-6 illustrate variations or modifications that may be made to the tape structures and/or separator structure illustrated in FIGS. 1A-E. FIGS. 7A-7D illustrate a second example separator structure that may be formed from two tape structures. FIGS. 8A-8E illustrate a third example separator structure that may be formed from two tape structures. It will be appreciated that any of the separator structures illustrated in FIGS. 7A-8E may be modified in a similar manner as the separator structures illustrated in FIGS. 1A-6. Additionally, a wide variety of other types of separator structures and/or tape structures may be utilized in accordance with various embodiments, and those described herein are provided by way of illustrative example only.

Figure 1B:
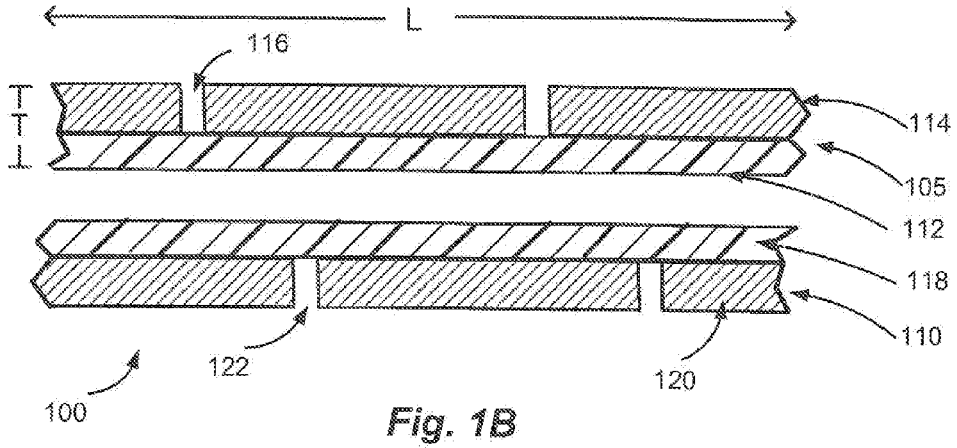
Figure 1C:
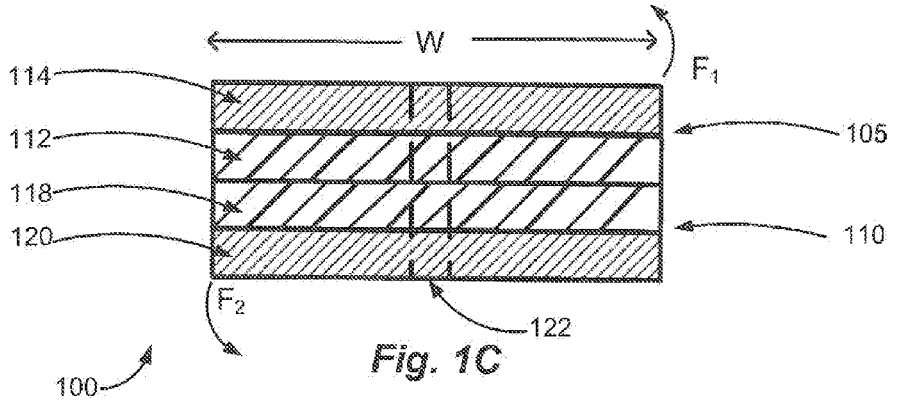

Turning first to FIG. 1A, a top level view of two example tape structures 105, 110 (or tapes 105, 110) that may be utilized to form a separator structure 100 (or separator 100) are illustrated. FIG. 1B illustrates a side view of the two tapes 105, 110, and FIG. 1C illustrates a cross-sectional view of the two tapes 105, 110 taken across a width dimension. Each of the tapes 105, 110 may extend along a longitudinal direction "L" that may correspond to a longitudinal dimension of a cable into which the separator 100 is incorporated. Additionally, each tape 105, 110 may have a suitable width and thickness. As shown in FIG. 1A, in certain embodiments, the first tape 105 may have a width "$W_1$" that is approximately equal to a width "$W_2$" of the second tape 110. Accordingly, when positioned adjacent to one another in a stacked configuration as shown in FIG. 1C, a single width "W" may be applicable to both tapes 105, 110. In other embodiments, as explained in greater detail below, two tapes having different widths may be utilized to form a separator. Additionally, as shown in FIG. 1B, the first tape 105 and the second tape 110 may have respective thicknesses "T" that are approximately equal. However, in other embodiments, two tape structures with different thicknesses may be utilized.

Each tape 105, 110 may be formed with a wide variety of suitable dimensions as desired in various embodiments. For example, each tape 105, 110 may be formed with any suitable length, width, and/or thickness. In certain embodiments, each tape 105, 110 may be formed as a relatively continuous structure along its longitudinal length. In other words, each tape 105, 110 may have a respective longitudinal length "L" that extends approximately along an entire length of a cable into which the tapes are incorporated. In other embodiments, each tape 105, 110 may be formed from a plurality of discrete or severed sections that are arranged adjacent to one another along a longitudinal direction. For example, sections or portions of a tape may be arranged end-to-end along a longitudinal direction, and the combination of sections may function as a single tape. Each section may be formed with any suitable longitudinal length and, as desired in various embodiments, section lengths may be formed in accordance with a pattern or in a random or pseudo-random fashion. When a separator 100 is formed from the two tapes 105, 110, the separator 100 may also have a plurality of discrete or severed sections that are longitudinally arranged. In yet other embodiments, a first tape may be formed from a plurality of discrete sections while a second tape is formed as a relatively continuous structure.

Additionally, each tape 105, 110 may be formed with any suitable width, such as the illustrated widths $W_1$, $W_2$. As desired, a width of a tape (generally referred to as tape 105 but equally applicable to other tape structures) may correspond to a desired purpose of the tape once incorporated into a separator structure. For example, in the event that a separator 100 is only positioned between a plurality of twisted pairs (i.e., the separator does not also function as an outer shield layer), then a tape 105 may have a width that is approximately equal to the combined cross-sectional length of two prongs or extensions of the separator 100. In other words, when the tape 105 is folded as described in greater detail below such that the tape 105 forms two prongs (or one half) of a separator 100, the two widthwise edges of the tape 105 may be positioned at the ends of the two prongs. As another example, a tape 105 may have a width that facilitates one or both of the widthwise edges of the tape 105 extending beyond an outer periphery of the twisted pair conductors such that the tape 105 can be wrapped or curled around the outer periphery. In other words, a tape 105 may have a width that facilitates one or more prongs extending beyond the twisted pairs such that the tape 105 may further form at least a portion of an outer shield layer or wrap. A few non-limiting examples of separator structures in which one or more tapes are wrapped around an outer periphery of the twisted pair conductors are described in greater detail below with reference to FIGS. 2A-6, 7D, and 8E.

In certain embodiments, a tape 105 may be formed with a width between approximately 3.0 mm and approximately 30.0 mm. For example, a tape 105 may be formed with a width of approximately 3.0 mm, 4.0 mm, 5.0 mm, 6.0 mm, 7.0 mm, 8.0 mm, 9.0 mm, 10.0 mm, 12.0 mm, 15.0 mm, 17.0 mm, 20.0 mm, 22.0 mm, 25.0 mm, 27.0 mm, 30.0 mm, a width included in a range between any two of the previous values, or a width included in a range bounded on either a minimum or maximum end by one of the previous values. Additionally, in certain embodiments, the two tapes 105, 110 utilized to form a separator 100 may have widths that are substantial similar or approximately equal. In other embodiments, the two tapes 105, 110 may have different widths. For example, a first tape may have a width that facilitates wrapping one or more portions of the tape around an outer periphery of twisted pairs positioned adjacent to a separator 100 while the second tape has a width that only facilitates the formation of prongs included in the separator 100. Additionally, in certain embodiments, the width of a tape 105 may vary along its longitudinal length. For example, a tape 105 may be utilized to form spaced prongs or extensions along a longitudinal length of a separator 100 and gaps may be present between adjacent prongs. As desired, prongs or extensions may have any suitable lengths and a wide variety of suitable gap distances may be utilizes. Additionally, the spaced prongs may be formed in accordance with a wide variety of suitable patterns or in a random or pseudo-random manner. Indeed, a wide variety of different width dimensions and/or configurations may be utilized as desired for one or both of the tapes 105, 110.

Each tape 105 may also be formed with any suitable thickness, such as the thickness "T" illustrated in FIG. 1B. Further, in the event that the tape 105 is formed from a plurality of layers (e.g., a dielectric layer and a shielding layer), each layer may have any suitable thickness. In certain embodiments, a tape 105 may be formed with a thickness between approximately 50 μm and approximately 100 μm. For example, a tape 105 may be formed with a thickness of approximately 50 μm, 60 μm, 70 μm, 80 μm, 90 μm, 100 μm, a thickness included in a range between any two of the previous values, or a thickness included in a range bounded on either a minimum or maximum end by one of the previous values. Additionally, in certain embodiments, the two tapes 105, 110 utilized to form a separator 100 may have thickness that are substantial similar or approximately equal. In other embodiments, the two tapes 105, 110 may have different thickness. Further, in certain embodiments, the thickness of a tape 105 may vary along one or more other dimensions, such as along a width dimension. For example, as explained in greater detail below with reference to FIGS. 8A-8E, a tape 105 may be formed with a respective shielding material layer on opposite sides of a base dielectric layer, and each shielding layer may extend partially across a width of the tape 105. As another example, a first portion of a tape 105 (e.g., a portion that forms prongs of a separator) may be formed with a greater thickness than a second portion of the tape 105 (e.g., a portion that is wrapped around an outer periphery of twisted pairs). Indeed, a wide variety of different thicknesses and/or thickness configurations may be utilized as desired for one or both of the tapes 105, 110.

Each tape 105, 110 may be formed from a wide variety of suitable materials and/or combinations of materials. For example, a tape 105 may be formed from any suitable dielectric, and/or shielding materials. In certain embodiments, a tape 105 may be formed from a single layer of material, such as layer of dielectric material or a layer of shielding material (e.g., a metallic foil, a semi-conductive material, etc.). In other embodiments, a tape 105 may be formed as a suitable metallic braid. In yet other embodiments, a tape 105 may be formed with a plurality of layers of material. For example, a tape 105 may be formed with one or more dielectric layers and one or more layers of shielding material.

As shown in FIGS. 1A-IC, in certain embodiments, each tape 105, 110 may include a base dielectric layer and at least one layer of shielding material may be formed on, attached to, or otherwise associated with the base dielectric layer. For example, the first tape 105 may include a base dielectric layer 112 and a layer of shielding material 114 may be formed on the base layer 112. As shown, the layer of shielding material 114 may include a plurality of discontinuous patches of shielding material with respective gaps 116 or spaces positioned between adjacent patches; however, as set forth in greater detail below, a wide variety of other shielding material configurations may be utilized.

Similarly, the second tape 110 may include a base dielectric layer 118 and a layer of shielding material 120 may be formed on the base dielectric layer 118. The layer of shielding material 120 may include a plurality of discontinuous patches of material with respective gaps 122 or spaces positioned between adjacent patches. As desired in certain embodiments, a tape may include additional layers of dielectric material (e.g., a sandwich layer formed on an opposite side of the shielding material, etc.) and/or additional layers of shielding material. Indeed, a tape may be formed in accordance with a wide variety of suitable constructions that include any number of layers.

In certain embodiments, a dielectric layer, such as base dielectric layers 112, 118, may be formed from or formed substantially from one or more dielectric materials. A wide variety of suitable dielectric materials may be utilized including, but not limited to, paper, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, polytetrafluoroethylene, ethylene tetrafluoroethylene ("ETFE"), ethylene chlorotrifluoroethylene ("ECTFE"), etc.), one or more polyesters, polyimide, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, one or more foamed materials may be utilized. Indeed, a dielectric layer may be filled, unfilled, foamed, un-foamed, homogeneous, or inhomogeneous and may or may not include one or more additives (e.g., flame retardant and/or smoke suppressant materials). Additionally, as set forth above, a dielectric layer may be formed with a wide variety of suitable thickness, such as a thickness between approximately 10 μm and approximately 40 μm.

A shielding layer, such as shielding layers 114, 120, may be formed from a wide variety of suitable shielding materials and/or with a wide variety of suitable dimensions. In certain embodiments, a shielding layer may be formed as a relatively continuous layer that includes shielding material extending substantially along a longitudinal length of a tape. In other embodiments, as shown in FIGS. 1A-B, a shielding layer may be formed as a discontinuous layer having a plurality of isolated patches of shielding material. For example, a plurality of patches of shielding material may be incorporated into a shielding layer, and gaps or spaces may be present between adjacent patches in a longitudinal direction. A wide variety of different patch patterns may be formed as desired, and a patch pattern may include a period or definite step. In other embodiments, patches may be formed in a random or pseudo-random manner. Additionally, for discontinuous shields, individual patches may be separated from one another so that each patch is electrically isolated from the other patches. That is, the respective physical separations between the patches may impede the flow of electricity between adjacent patches. In certain embodiments, the physical separation of other patches may be formed by gaps or spaces, such as gaps of dielectric material or air gaps.

A wide variety of suitable materials and/or combination of materials may be utilized to form a shielding layer and/or patches of shielding material. In certain embodiments, one or more electrically conductive materials may be utilized including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

Additionally, a shielding layer and/or associated shielding material may be incorporated into a tape 105 utilizing a wide variety of suitable techniques and/or configurations. For example, shielding material may be formed on a base layer or a dielectric layer. In certain embodiments, a separate base dielectric layer and shielding layer may be bonded, adhered, or otherwise joined (e.g., glued, etc.) together to form a tape. In other embodiments, shielding material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the patches of shielding material can be over-coated with a dielectric layer or electrically insulating film, such as a polyester coating. In other embodiments, shielding material may be embedded into a base layer or dielectric layer. In yet other embodiments, a tape may be formed (e.g., extruded, etc.) from a shielding material.

Additionally, a shielding layer and/or various patches included in a shielding layer 114 may have a wide variety of suitable dimensions. For example, shielding material may have any desired thickness, such as a thickness of about 0.5 mils (about 13 microns) or greater. In many applications, signal performance benefits from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils.

As shown in FIG. 1A, in certain embodiments, a shielding layer may include patches of shielding material that extend substantially across a width dimension of a tape. For example, the shielding layer 114 may have patches of shielding material having a width that is approximately equal to the width $W_1$ of the base dielectric layer 112 and the overall tape 105. In other embodiments, shielding material may be formed with a width that is different than the width of a base dielectric layer. For example, one or more patches of shielding material may extend partially across a width of a base dielectric layer 112. In certain embodiments, more narrow patches of shielding material may assist in the manufacturing or construction of a tape. For example, a relatively continuous layer of shielding material may be formed on a base dielectric layer and one or more punches or other suitable cutting tools may be utilized to form holes through the combined shielding layer and underlying base layer. The holes may function as gaps between adjacent patches of shielding material within a discontinuous shield structure. Additionally, the holes may be formed across a width dimension of the shielding material without being formed across the entire width dimension of the base layer. In this regard, the base layer may be relatively continuous.

In other embodiments, the width of shielding material may be determined based at least in part upon a desired shielding function. For example, shielding material may be formed with a width such that it is only positioned on a separator prong between two twisted pairs. As another example, shielding material may be formed with a width such that it is only positioned on a portion of a separator that is wrapped around an outer circumference or periphery of the twisted pairs. In certain embodiments, as shown in FIGS. 8A-E and explained in greater detail below, shielding material may be formed on opposite sides of a base dielectric layer. The shielding material formed on a first side of the dielectric layer may be positioned on a portion of a separator prong positioned between two twisted pairs while the shielding material formed on the opposite side of the dielectric layer may be positioned on a portion of the prong that is wrapped around an outer periphery of the twisted pairs. As desired, each section or portion of shielding material may have any suitable width.

As set forth above, a shielding layer (and/or various segments of a shielding layer), such as shielding layer 114, may include a plurality of discontinuous patches of shielding material. Each of the patches may be formed with a wide variety of suitable patch lengths (e.g., lengths along a longitudinal direction of a tape and/or separator structure). As desired, the dimensions of the patches can be selected to provide electromagnetic shielding over a specific band of electromagnetic frequencies or above or below a designated frequency threshold. In certain embodiments, each segment and/or patch may have a length of about one meter to about one hundred meters, although lengths of less than one meter (e.g., lengths of about 1.5 to about 2 inches, etc.) may be utilized. For example, the segments and/or patches may have a length in a range of about one to ten meters. In various embodiments, the segments and/or patches can have a length of about 0.1, 0.2, 0.25, 0.3, 0.4, 0.5, 0.6, 0.7, 0.75, 0.8, 0.9, 1.0, 1.5, 2.0, 2.5, 3.0, 3.5, 4.0, 4.5, or 5.0 meters, a length included in a range between any two of the above values, or a length included in a range bounded on either a minimum or maximum end by one of the above values.

Additionally, a wide variety of suitable gap distances or isolation gaps (e.g., a longitudinal distance for gap 116, etc.) may be provided between adjacent patches. For example, the isolation spaces can have a length of about 0.5, 1.0, 1.5, 2.0, 2.5, 3.0, 3.5, 4, 5, 6, 7, 8, 9, or 10 mm, a length included in a range between any two of the above values, or a length included in a range bounded on either a minimum or maximum end by one of the above values. In one example embodiment, each patch may be at least two meters in length, and a relatively small isolation gap (e.g., 4 millimeters or less, about 1/16 of an inch, etc.) may be formed between adjacent patches. As explained in greater detail below with reference to FIG. 9F, in certain embodiments, a plurality of microcuts may be utilized to form a gap between two patches. Additionally, as desired, first patches may be formed on a first side of a dielectric layer and second patches may be formed on an opposite side of the dielectric layer. In certain embodiments, the second patches may be formed to correspond with the gaps or isolation spaces between the first patches. As desired, the patches may have a wide variety of different shapes and/or orientations. For example, the patches may have a rectangular, trapezoidal, or parallelogram shape. A few example shapes for patches are described in greater detail below with reference to FIGS. 9A-9G. Additionally, in certain embodiments, a first tape 105 and a second tape 110 may include similar patch patterns. In other embodiments, different patch patterns may be formed on the two tapes 105, 110 and/or in various sections (e.g., sections between positioned between twisted pairs, sections wrapped around an outer periphery of the twisted pairs, etc.) of the two tapes 105, 110.

In certain embodiments, shield layer sections or patches may be formed to be approximately perpendicular (e.g., square or rectangular segments and/or patches) to the longitudinal axis of twisted pairs incorporated into a cable (e.g., pairs adjacent to the separator 100, etc.). In other embodiments, the patches may have a spiral direction that is opposite the twist direction of one or more pairs. That is, if the twisted pair(s) are twisted in a clockwise direction, then the segments and/or patches may spiral in a counterclockwise direction. If the twisted pair(s) are twisted in a counterclockwise direction, then the conductive patches may spiral in a clockwise direction. Thus, twisted pair lay opposes the direction of the segment and/or patch spiral. The opposite directions may provide an enhanced level of shielding performance. In other embodiments, patches may have a spiral direction that is the same as the twist direction of one or more pairs.

Additionally, in certain embodiments, a wide variety of different sections and/or patches of shielding material may be formed with different dimensions. In certain embodiments, different sections of shielding material may be formed with different thicknesses. For example, first shielding material formed on a section of a tape to be positioned between twisted pairs when a separator is formed may have a first thickness while second shielding material formed on a section of the tape to be wrapped around an outer circumference of the twisted pairs (e.g., a portion of a separator prong that extends beyond the outer circumference) may have a second thickness different than the first thickness. Similarly, different types of shielding material and/or different configurations of shielding material (e.g., different patch configurations, etc.) may be formed in different sections of a tape. In certain embodiments, different shielding thicknesses, materials, and/or configurations may be selected in order to achieve desired shielding functions for various portions of a separator structure.

As set forth above, in certain embodiments, one or more tapes 105, 110 and/or a separator 100 formed from the tapes 105, 110 may include a plurality of longitudinally arranged discrete severed components. If severed, different components may be formed from the same materials and/or groups of materials. Alternatively, at least two components or segments may be formed from different materials and/or groups of materials. For example, a first segment may include relatively expensive flame retardant material (e.g., a dielectric layer incorporated into a tape may include flame retardant material, etc.) while a second segment does not. Other material combinations may be utilized as desired.

Once two tapes, such as tapes 105 and 110, have been provided, the two tapes may be utilized to form a suitable separator structure 100. With reference to FIG. 1C, which illustrates a cross-sectional view of the two tapes 105, 110 taken along a width dimension, the two tapes 105, 110 may be arranged in a stacked configuration in certain embodiments. As shown, the tapes 105, 110 may be arranged with their respective dielectric layers 112, 118 adjacent to and/or in contact with one another. Accordingly, the respective shielding layers 114, 120 of the two tapes 105, 110 may be the outer layers (e.g., the top and bottom layers) of the stack. In other embodiments, the tapes 105, 110 may be stacked in other configurations or arrangements. For example, the tapes 105, 110 may be stacked with their shielding layers 114, 120 adjacent to one another. As another example, the tapes 105, 110 may be stacked with each tape having a similar orientation. In this regard, the dielectric layer of the first tape 105 may be adjacent to the shielding layer 120 of the second tape 110, or vice versa.

In certain embodiments, the two tapes 105, 110 may be bonded or joined together. For example, the tapes 105, 110 may be bonded together along a longitudinally extending line 122 or at one or more locations along a longitudinally extending line. The longitudinally extending line 122 may extend through any desired respective positions or portions of each of the tapes 105, 110. As shown in FIG. 1C, the longitudinally extending line 122 may be positioned approximately at a midpoint along a respective width dimension of each of the tapes, for example at a midpoint along both width $W_1$ and width $W_2$. In other embodiments, the longitudinally extending line 122 may be positioned such that it is offset from a width dimension midpoint on one or both tapes 105, 110. A few example embodiments in which a longitudinally extending line may be offset are described in greater detail below with reference to FIGS. 5 and 6. Regardless of the positioning of the longitudinally extending line 122 along the width dimensions of the tapes 105, 110, in certain embodiments, the longitudinally extending line 122 may be positioned proximate to respective folds and/or fold lines that may be formed in each of the tapes 105, 110. As explained in greater detail below, each of the tapes 105, 110 may be longitudinally folded such that each tape forms two respective prongs of a separator 100. In the event that the tapes 105, 110 are bonded together, the tapes 105, 110 may be bonded proximate to the longitudinal fold lines. Additionally, in certain embodiments, the longitudinally extending line 122 may be positioned approximately at a cross-sectional center point of a twisted pair component, for example, at a cross-sectional center point between a plurality of twisted pairs.

A wide variety of suitable methods and/or techniques may be utilized to bond or join the two tapes 105, 110 together. In certain embodiments, the tapes 105, 110 may be adhered together with one or more suitable adhesives including, but not limited, to glue, epoxy, pressure sensitive adhesive, contact adhesive, thermoset adhesive, radiation curable adhesive, etc. In other embodiments, the tapes 105, 110 and/or their respective dielectric layers 112, 118 may be ultrasonically welded or bonded together. In yet other embodiments, the tapes 105, 110 may be attached together with any number of suitable mechanical fasteners, such as staples, pins, rivets, etc. In yet other embodiments, one or more mechanical folds may be utilized to bond the tapes 105, 110 together without adding additional bonding material. In certain embodiments, one or more of the tapes 105, 110 may be constructed to include an adhesive (e.g., a longitudinal line of adhesive, etc.) that is covered by a suitable film layer. During assembly of a separator 100, the film layer may be removed such that the two tapes 105, 100 may be bonded together.

Additionally, in certain embodiments, the tapes 105, 110 may be bonded together continuously along the longitudinally extending line 122. In other embodiments, the tapes 105, 110 may be bonded together at a plurality of discrete points or locations along the longitudinally extending line 122. For example, the tapes 105, 110 may be ultrasonically welded together in spaced sections or attached together with spaced mechanical fasteners. As desired, spaced points or sections for bonding may be formed in accordance with any desired pattern or, alternatively, in a random or pseudo random fashion. Additionally, attachment sections may have any suitable longitudinal length and any desired separation distance may be present between adjacent attachment sections. In yet other embodiments, the tapes 105, 110 may not be bonded together. In other words, a separator 100 may be formed from the two tapes 105, 110 and the relative positions of the tapes 105, 110 may be maintained by other components of a cable, such as twisted pairs positioned adjacent to the separator 100.

According to an aspect of the disclosure, each of the tapes 105, 110 may be longitudinally folded. In other words, a longitudinally extending fold may be formed in each tape at a desired location along the tape's width dimension. Once folded, each tape may extend in two directions from the fold. In this regard, each tape may form two prongs of a separator 100. Additionally, the respective longitudinally extending folds of each tape 105, 110 may be arranged or positioned proximate to one another in a separator 100. For example, the folds may be positioned at a central point positioned between a plurality of twisted pairs, and portions of the tapes 105, 110 that function as prongs of the separator 100 may extend from the central point. In the event that the two tapes 105, 110 are bonded together, the tapes 105, 110 may be bonded at or near their longitudinally extending folds. In certain embodiments, a longitudinally extending fold may be positioned approximately at a midpoint along a width dimension of a tape. In other embodiments, a longitudinally extending fold may be positioned such that it is offset from a width dimension midpoint of a tape.

With reference to FIG. 1C, once the tapes 105, 110 are arranged in a stacked configuration, a respective fold may be formed in each of the tapes 105, 110. For example, a first longitudinal edge of a first tape 105 may be folded in a first fold direction "$F_1$". In this regard, a first longitudinally extending fold line may be formed, for example, approximately at a midpoint along a width of the first tape 105. Similarly, a second longitudinal edge of the second tape 110 opposite the first longitudinal edge along a width dimension may be folded in a second fold direction "$F_2$" that is opposite the first fold direction. In this regard, a second longitudinally extending fold line may be formed, for example, approximately at a midpoint along a width of the second tape 110. In one example embodiment, an edge of the first tape 105 may be folded in an upward direction while an opposite widthwise edge of the second tape 110 may be folded in a downward direction. Other suitable folding arrangements may be utilized such that a fold is imparted in each of the tapes and each tape forms two respective prongs of a separator 100.

A wide variety of suitable methods and/or techniques may be utilized to fold each of the tapes 105, 110. Examples of suitable equipment that may be utilized to fold the tapes include, but are not limited to, folding dies, rollers, air knives, etc. In certain embodiments, respective folds may be formed in each tape that is arranged in a stacked configuration. For example, the stacked arrangement of the tapes 105, 110 illustrated in FIG. 1C may be passed through one or more folding dies that form respective folds in each tape in order to produce a separator structure similar to that illustrated in FIG. 1D. In other embodiments, each tape may be individually folded, and the folded tapes may be positioned proximate to one another. For example, the respective fold lines formed in each tape may be positioned proximate to one another in order to form a separator structure similar to that illustrated in FIG. 1D. In certain embodiments, the two individually folded tapes may be bonded or attached together. In other embodiments, the folded tapes may not be bonded together.

Figure 1D:
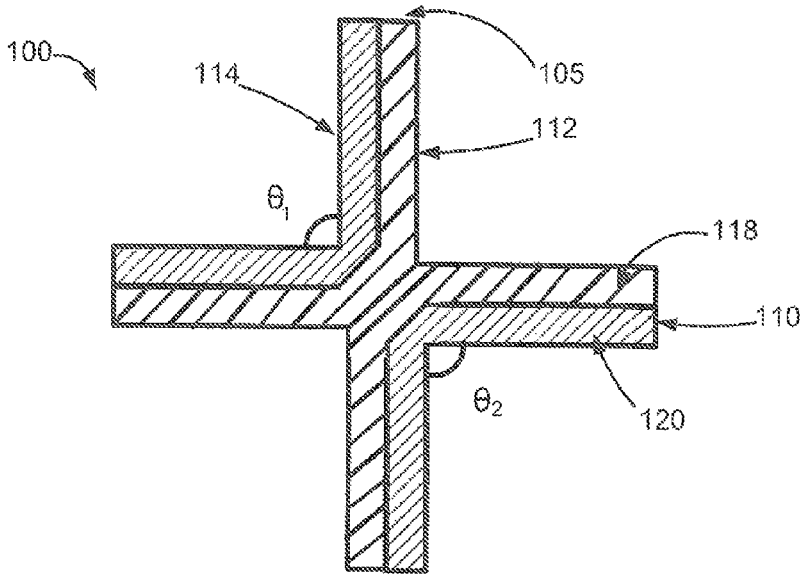
FIG. 1D is a cross-sectional view of an example separator structure formed from the example tape structures illustrated in FIGS. 1A-C.

FIG. 1D is a cross-sectional view of an example separator structure 100 (or separator 100) formed from the example tape structures 105, 110 illustrated in FIGS. 1A-C. The separator 100 includes four prongs that extend approximately from a central point. A first tape 105 may be folded such that it forms two prongs of the separator 100. A first longitudinally extending widthwise edge of the first tape 105 may be positioned at an end of a first prong while a second longitudinally extending widthwise edge of the tape 105 may be positioned at an end of a second prong. Similarly, a second tape 110 may be folded to form the other two prongs of the separator 100. A first longitudinally extending widthwise edge of the second tape 110 may be positioned at an end of a third prong while a second longitudinally extending widthwise edge of the tape 110 may be positioned at an end of a fourth prong. In this regard, a separator 100 with an approximately cross-shaped cross-section may be formed.

Each of the tapes 105, 110 may be folded at any suitable angle as desired in various embodiments. As shown, the first tape 105 may be folded at a first angle "$\theta_1$", and the second tape may be folded at a second angle "$\theta_2$". As shown, each of the angles $\theta_1$ and $\theta_2$ may be an approximately ninety degree (90°) angle. Other suitable angles may be utilized in other embodiments, such as angles of approximately 45, 60, 70, 80, 90, 100, 110, 120, or 135 degrees, an angle included in a range between any two of the above values, or an angle included in a range bounded on either a minimum or maximum end by one of the above values. Further, in certain embodiments, the first angle and the second angle may be approximately equal. In other embodiments, the first angle may be different than the second angle. In certain embodiments, a tape may be folded to a desired angle during processing. In other embodiments, tape may be over-folded (e.g., folded a greater amount than a desired angle) and then allowed to spring back either before or during the positioning of the tape between a plurality of twisted pairs. Additionally, as set forth above, the tapes 105, 110 may optionally be bonded together.

Figure 1E:
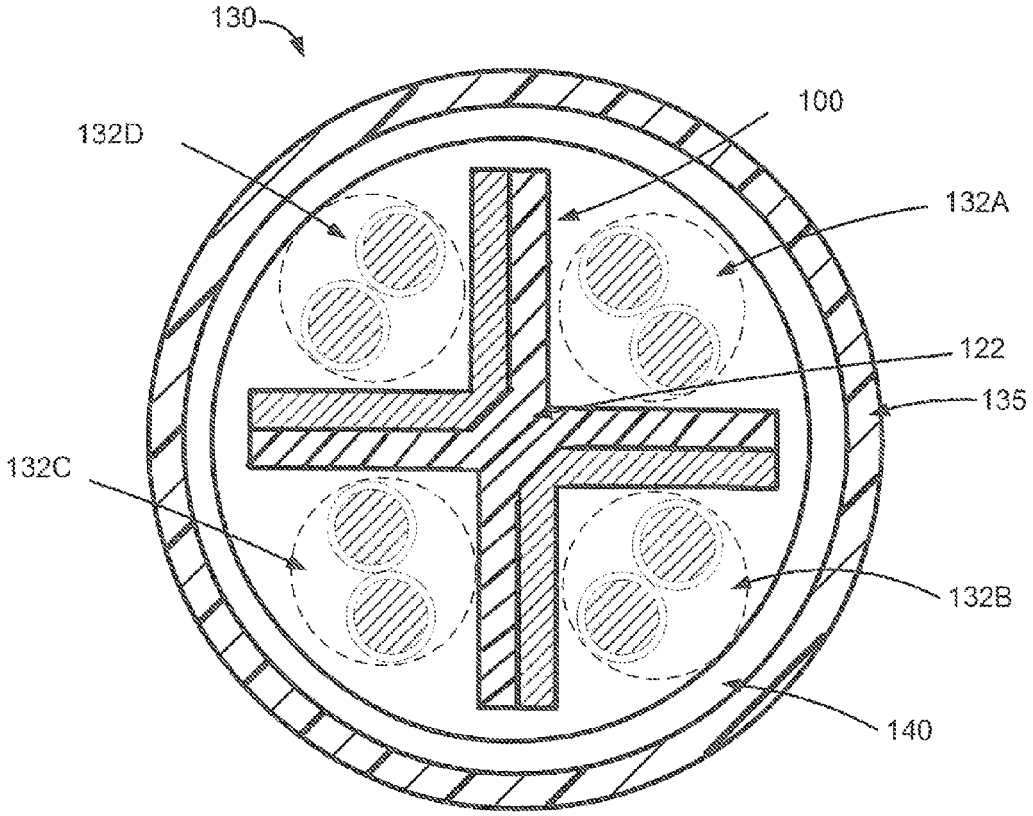
FIG. 1E is a cross-sectional view of a cable that incorporates an example separator structure in accordance with an illustrative embodiment of the disclosure.

The separator 100 may be incorporated into a twisted pair component. In other words, the separator 100 may be positioned between a plurality of twisted pairs incorporated into a cable or cable component. The separator 100 may function to orient the twisted pairs and/or maintain the relative positions of the twisted pairs. Additionally, in certain embodiments, the separator 100 may provide electromagnetic shielding for one or more of the twisted pairs. FIG. 1E is a cross-sectional view of an example cable 130 that incorporates a separator formed in accordance with an embodiment of the disclosure, such as the separator 100 illustrated in FIG. 1D. As shown, the cable 130 may include a plurality of twisted pairs, such as the illustrated four twisted pairs 132A, 132B, 132C, 132D. An outer jacket 135 may then be formed around the twisted pairs 132A-D and the separator 100. In certain embodiments, one or more suitable shield layers, such as an external shield 140 may also be incorporated into the cable 130. Each of these components is described in greater detail below.

Although the cable 130 is illustrated as having four twisted pairs 132A, 132B, 132C, 132D, any other suitable number of pairs may be utilized and a construction of the separator 100 may be modified in order to accommodate the twisted pairs. For example, additional tapes may be incorporated into the separator in order to accommodate a greater number of twisted pairs. Each twisted pair (generally referred to as twisted pair 132) may include two electrical conductors, each covered with suitable insulation. Each twisted pair 132 can carry data or some other form of information, for example in a range of about one to ten Giga bits per second ("Gbps") or another appropriate frequency, whether faster or slower. As desired, each of the twisted pairs may have the same twist lay length or alternatively, at least two of the twisted pairs may include a different twist lay length. For example, each twisted pair may have a different twist rate. The different twist lay lengths may function to reduce crosstalk between the twisted pairs. A wide variety of suitable twist lay length configurations may be utilized. Additionally, in certain embodiments, each of the twisted pairs 132A-D may be twisted in the same direction (e.g., clockwise, counter clockwise). In other embodiments, at least two of the twisted pairs 132A-D may be twisted in opposite directions. Further, as desired in various embodiments, one or more of the twisted pairs 132A-D may be twisted in the same direction as an overall bunch lay of the combined twisted pairs. For example, the conductors of each of the twisted pairs 132A-D may be twisted together in a given direction. The plurality of twisted pairs 132A-D may then be twisted together in the same direction as each of the individual pair's conductors. In other embodiments, at least one of the twisted pairs 132A-D may have a pair twist direction that is opposite that of the overall bunch lay. In yet other embodiments, all of the twisted pairs 132A-D may have pair twist directions opposite that of the overall hunch lay.

The electrical conductors of a twisted pair 132 may be formed from any suitable electrically conductive material, such as copper, aluminum, silver, annealed copper, gold, a conductive alloy, etc. Additionally, the electrical conductors may have any suitable diameter, gauge, and/or other dimensions. Further, each of the electrical conductors may be formed as either a solid conductor or as a conductor that includes a plurality of conductive strands that are twisted together. The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, choloro-sulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 132A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs 132A-D in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

The jacket 135 may enclose the internal components of the cable 130, seal the cable 130 from the environment, and provide strength and structural support. The jacket 135 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 135 may be formed as a single layer or, alternatively, as multiple layers. In certain embodiments, the jacket 135 may be formed from one or more layers of foamed material. As desired, the jacket 135 can include flame retardant and/or smoke suppressant materials. Additionally, the jacket 135 may include a wide variety of suitable shapes and/or dimensions. For example, the jacket 135 may be formed to result in a round cable or a cable having an approximately circular cross-section; however, the jacket 135 and internal components may be formed to result in other desired shapes, such as an elliptical, oval, or rectangular shape. The jacket 135 may also have a wide variety of dimensions, such as any suitable or desirable outer diameter and/or any suitable or desirable wall thickness. In various embodiments, the jacket 135 can be characterized as an outer jacket, an outer sheath, a casing, a circumferential cover, or a shell.

An opening enclosed by the jacket 135 may be referred to as a cable core, and the twisted pairs 132A-D and the separator 100 may be disposed within the cable core. Although a single cable core is illustrated in FIG. 1E, a cable may be formed to include multiple cable cores. In certain embodiments, a cable core may be filled with a gas such as air (as illustrated) or alternatively a gel, solid, powder, moisture absorbing material, water-swellable substance, dry filling compound, or foam material, for example in interstitial spaces between the twisted pairs 132A-D. Other elements can be added to the cable core as desired, for example one or more optical fibers, additional electrical conductors, additional twisted pairs, water absorbing materials, and/or strength members, depending upon application goals.

With continued reference to the cable 130 of FIG. 1E, in certain embodiments, one or more shields can be disposed between the jacket 135 and one or more additional cable components. For example, as shown in FIG. 1E, an external shield 140 or an overall shield may be formed around the twisted pairs 132A-D and the separator 100. In other words, the external shield may be wrapped around and/or encompass the collective group of twisted pairs. In certain embodiments, the shield 140 may be positioned between the twisted pairs 132A-D and the outer jacket 135. In other embodiments, the shield 140 may be embedded into the outer jacket 135, incorporated into the outer jacket 135, or even positioned outside of the outer jacket 135. In other embodiments, individual shields may be provided for each of the twisted pairs. As desired, multiple shields may be provided, for example, individual shields and an overall shield. Each shield may incorporate electrically conductive material, semi-conductive material, or dielectric shielding material in order to provide electrical shielding for one or more cable components. Further, each shield may be formed with a wide variety of suitable constructions. For example, similar to the tapes 105, 110 utilized to form the separator 100, a shield may be formed from a multi-layer tape structure having any number of dielectric and/or shielding layers.

In other embodiments, as explained in greater detail below, the separator 100 may be utilized to form a portion or all of an outer or external shield around the twisted pairs 132A-D. For example, one or more prongs of the separator 100 may extend beyond an outer periphery defined by the twisted pairs 132A-D, and the extending portion(s) may be wrapped around the outer periphery. In the event that the separator 100 also functions as an outer shield, a cable or cable component may be formed without a separate external shield.

As desired in various embodiments, a wide variety of other materials may be incorporated into the cable 130. For example, the cable 130 may include any number of conductors, twisted pairs, optical fibers, and/or other transmission media. As another example, one or more respective dielectric films or other suitable components may be positioned between the individual conductors of one or more of the twisted pairs 132A-D. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), insulating materials, dielectric materials, flame retardants, flame suppressants or extinguishants, gels, armor layers, and/or other materials. The cable 130 illustrated in FIG. 1E is provided by way of example only. Embodiments of the disclosure contemplate a wide variety of other cables and cable constructions. These other cables may include more or less components than the cable 130 illustrated in FIG. 1E. Additionally, certain components may have different dimensions and/or materials than the components illustrated in FIG. 1E.

Additionally, although FIG. 1E illustrates a jacketed cable, the separator 100 may be incorporated into a wide variety of other cable components. For example, the separator 100 may be incorporated into an unjacketed twisted pair component or twisted pair core that is incorporated into a larger cable structure. FIGS. 2B, 3B, 4-6, 7D, and 8E illustrate unjacketed components that include a suitable separator structure and a plurality of twisted pairs. It will be appreciated that a jacket could be formed around any of the illustrated unjacketed components or, alternatively, a component may be incorporated into a larger cable structure.

FIGS. 2A-6 are cross-sectional views of example separator structures that may function as both a separator and a shield. Each of the example separator structures or separators illustrated in FIGS. 2A-6 may be formed from two tapes. In certain embodiments, each separator may include two tapes having similar constructions to those discussed above with reference to FIGS. 1A-C. In other embodiments, one or more tapes may be formed with alternative constructions. In other words, tapes may be formed with a wide variety of suitable materials, layers, and/or dimensions. Additionally, as desired in various embodiments, any of the separators described herein may be modified to include any of the features discussed below with reference to FIGS. 2A-6.

Figure 2A:
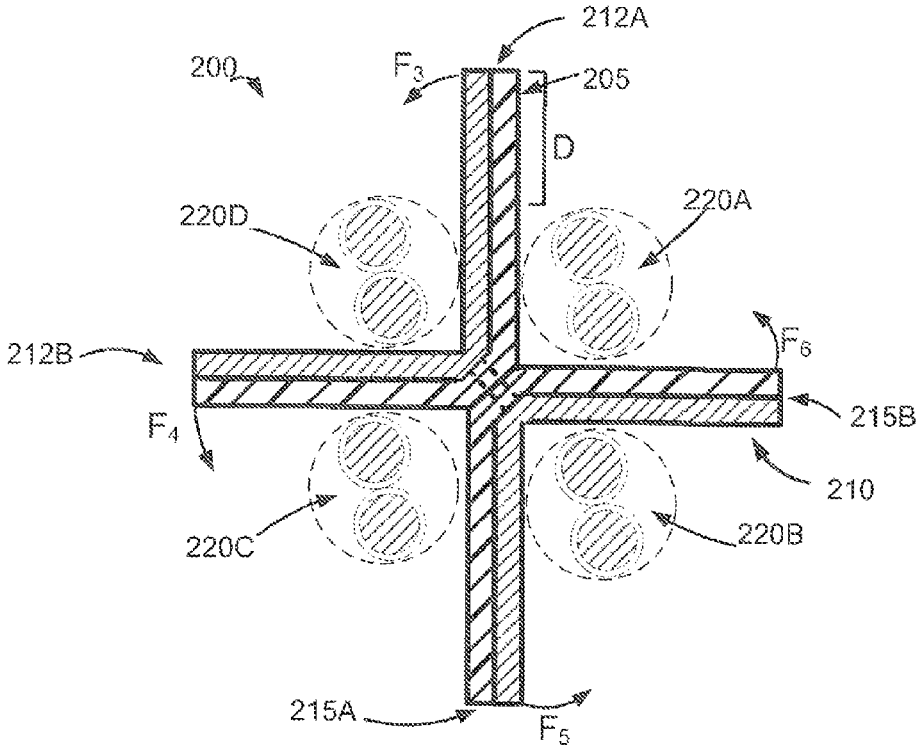
FIGS. 2A-6 are cross-sectional views of example separator structures that may function as both a separator and a shield.

Turning first to FIG. 2A, an example separator 200 may be formed from two tapes 205, 210. Each of the tapes 205, 210 may include a respective longitudinally extending fold, and each tape may extend in two direction from its longitudinally extending fold to form two prongs of the separator 200. In other words, a first tape 205 may form first and second prongs of the separator 200, and a second tape 210 may form third and fourth prongs of the separator. As set forth in greater detail above, a wide variety of suitable methods and/or techniques may be utilized to form the longitudinally extending folds in the tapes 205, 210. A respective twisted pair 220A-D may be positioned in each channel between the respective sets of adjacent prongs.

Additionally, at least one of the tapes 205, 210 may include a portion that extends beyond or past an outer circumference or periphery defined by the twisted pairs 220A-D. For example, at a given cross-sectional point along the length of the separator 200 and/or a cable into which the twisted pairs 220A-D and the separator 200 are incorporated, the plurality of twisted pairs 220A-D may occupy a given cross-sectional area that defines an outer periphery. In certain embodiments, one or both of the tapes 205, 210 may extend beyond the outer periphery of the twisted pairs 220A-D. In this regard, one or both of the tapes 205, 210 may include at least one portion that may be wrapped or curled at least partially around the outer periphery of the twisted pairs 220-D.

As shown in FIG. 2A, each of the tapes 205, 210 may extend beyond an outer periphery of the twisted pairs 220-D at two respective points or locations (i.e., at or near opposite widthwise edges of each tape). In other words, the first tape 205 may include a first longitudinally extending widthwise edge 212A that extends beyond the outer periphery at a first location and a second longitudinally extending widthwise edge 212B that extends beyond the outer periphery at a second location. Similarly, the second tape 210 may include a first longitudinally extending widthwise edge 215A that extends beyond the outer periphery at a third location and a second longitudinally extending widthwise edge 215B that extends beyond the outer periphery at a fourth location. In other embodiments, one or both tapes 205, 210 may extend beyond an outer periphery of the twisted pairs 220A-D at a single cross-sectional location. For example, one or both tapes 205, 210 may include a single longitudinally extending widthwise edge that extends beyond an outer periphery of the twisted pairs 220A-D. A few example embodiments in which tapes include single portions that extend beyond the twisted pairs are described in greater detail below with reference to FIGS. 5 and 6.

A portion of a tape 205, 210 extending beyond the outer periphery of the twisted pairs 220A-D may have a wide variety of suitable dimensions. For example, an extending portion may extend beyond the outer periphery by any suitable distance "D". Examples of suitable values for "D" include, but are not limited to distances of approximately 3.0 mm, 5.0 mm, 7.0 mm, 10.0 mm, 12.0 mm, 15.0 mm, 17.0 mm, 20.0 mm, distances included in a range between any two of the above values, or distances included in a range bounded on either a minimum or maximum end by one of the above values. In certain embodiments, the distance "D" may correlate to a desired degree of wrapping around the outer periphery. In other words, when the extending portion is wrapped or curled around the outer periphery of the twisted pairs 220A-D to form at least a portion of an outer shield, the distance "D" may correlate to a desired shield coverage. For example, the distance "D" may correspond to a length that is approximately one quarter (e.g., approximately 90°), approximately one half (e.g., approximately 180°), or approximately equivalent to (e.g., approximately 360°) the distance around the outer periphery of the twisted pairs 220A-D.

Additionally, in certain embodiments, a portion of a tape 205, 210 extending beyond the outer periphery of the twisted pairs 220A-D may be relatively continuous along a longitudinal length of the separator 200. In other words, a longitudinally extending widthwise edge may be continuous along the longitudinal length. In other embodiments, a width of a tape may be varied along its longitudinal length such that only certain portions extend beyond the outer periphery and/or such that various portions extend different distances beyond the outer periphery. Indeed, a wide variety of different configurations of tapes having varying widths may be utilized as desired. Additionally, as desired, a width may be varied in accordance with a desired patter or, alternatively, in a random or pseudo-random fashion. In the event that a width is varied, each portion of a tape (i.e., each portion having a given width) may have any desired longitudinal length.

In certain embodiments, an extending portion may have a similar construction as a portion of a separator 200 positioned between the twisted pairs 220A-D. For example, a tape 205, 210 may be formed with a uniform construction. In other embodiments, an extending portion may have a different construction than a portion positioned between the twisted pairs 220A-D. For example, an extending portion may have a different thickness (e.g., a shielding layer with a different thickness, etc.) than a portion positioned between the twisted pairs 220A-D. In this regard, an outer shield formed around the twisted pairs 220A-D may have a different thickness than a separator portion positioned between the pairs 220A-D. As another example, an extending portion may be formed from different material(s) (e.g., different shielding materials, etc.) than a portion positioned between the pairs 220A-D. As yet another example, an extending portion may be formed with a different number of layers and/or a different arrangement of layers relative to a portion positioned between the pairs 220A-D. Further, as desired, various sections of an extending portion may have different constructions. Indeed, a separator 200 may be formed with a wide variety of suitable configurations.

With continued reference to FIG. 2A, the two tapes 205, 210 may be bonded to one another along at least a portion of a longitudinally extending line 217. As set forth above, a wide variety of suitable methods and/or techniques may be utilized to bond the two tapes 205, 210. In other embodiments, such as the embodiment illustrated in FIG. 3A, two tapes utilized to form a separator may not be bonded or joined together.

Figure 2B:
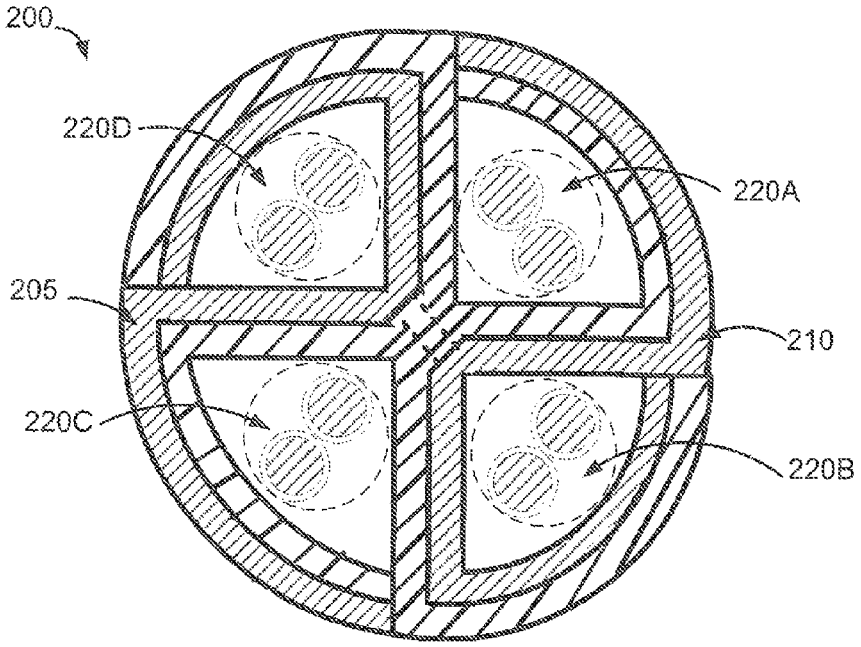

Once the two tapes 205, 210 are positioned between the twisted pairs 205, 210, the extending portions of the tapes 205, 210 may be wrapped, curled, or otherwise positioned around an outer periphery of the twisted pairs 220A-D. In certain embodiments, each of the extending portions may be wrapped or curled in a similar direction, such as a counterclockwise or clockwise direction. For example, a first extending portion of the first tape 205 (i.e., a portion ending at edge 212A) may be curled or wrapped in direction $F_3$, and a second extending portion of the first tape 205 (i.e., a portion ending at edge 212B) may be curled or wrapped in direction $F_4$. Similarly, a first extending portion of the second tape 210 (i.e., a portion ending at edge 215A) may be curled or wrapped in direction $F_5$, and a second extending portion of the second tape 210 (i.e., a portion ending at edge 215B) may be curled or wrapped in direction Fe. In this regard, the separator 200 may form an outer shield layer at least around the twisted pairs 220A-D. As depicted in FIG. 2B, the outer shield layer may encase or completely surround the twisted pairs 220A-D. In other embodiments, at least two extending portions may be curled or wrapped in opposite directions. In this regard, double shield layers may be formed as desired.

A wide variety of suitable methods and/or techniques may be utilized to wrap or curl the extending portion(s) around an outer periphery of the twisted pairs 220A-D. Examples of suitable equipment that may be utilized to wrap the extending portions include, but are not limited to, suitable dies, funnel, rollers, air knives, etc. In certain embodiments, an extending portion may be wrapped around the outer periphery of the twisted pairs 220A-D without substantially spiraling the outer portion around or about the twisted pair 220A-D. Alternatively, an extending portion may be wrapped so as to spiral around the twisted pairs 220A-D. Additionally, in certain embodiments, patches of shielding material incorporated into a tape or extending portion of a tape may face away from the twisted pairs 220A-D towards the exterior of a cable. In other embodiments, the patches of shielding material may face inward, towards the twisted pairs 220A-D. In yet other embodiments, conductive patches may be formed on both sides of a tape or extending portion.

In certain embodiments, once wrapped or curled around the twisted pairs 220A-D, certain extending portions may be bonded or attached together. For example, extending portions that are adjacent or in close proximity with one another following wrapping may be optionally bonded together. A wide variety of suitable methods and/or techniques may be utilized to bond or join extending portions together. In certain embodiments, extending portions may be adhered together with one or more suitable adhesives including, but not limited, to glue, epoxy, pressure sensitive adhesive, contact adhesive, thermoset adhesive, radiation curable adhesive, etc. In other embodiments, extending portions may be ultrasonically welded or bonded together. In yet other embodiments, extending portions may be attached together with any number of suitable mechanical fasteners, such as staples, pins, rivets, etc. In certain embodiments, one or more tapes may be constructed to include an adhesive (e.g., a longitudinal line of adhesive, etc.) that is covered by a suitable film layer at or near one or both longitudinally extending widthwise edges. Prior to and/or during a wrapping or curling operation of an extending portion, the film layer may be removed such that the extending portion may be bonded to another extending portion. As an alternative to bonding two extending portions to one another, an extending portion may be bonded to one or more of the twisted pairs 220A-D. In yet other embodiments, such as an embodiment in which an extending portion is wrapped around the entire outer periphery of the twisted pairs 220A-D, the extending portion may be bonded to itself.

Additionally, in certain embodiments, an extending portion may be bonded to another extending portion (or other component) continuously along the length of the separator 200. In other embodiments, an extending portion may be bonded to another component at a plurality of discrete points or locations along the longitudinally length of the separator 200. As desired, spaced points or sections for bonding may be formed in accordance with any desired pattern or, alternatively, in a random or pseudo random fashion. Additionally, bonding sections may have any suitable longitudinal length and any desired separation distance may be present between adjacent attachment sections.

Figure 3A:
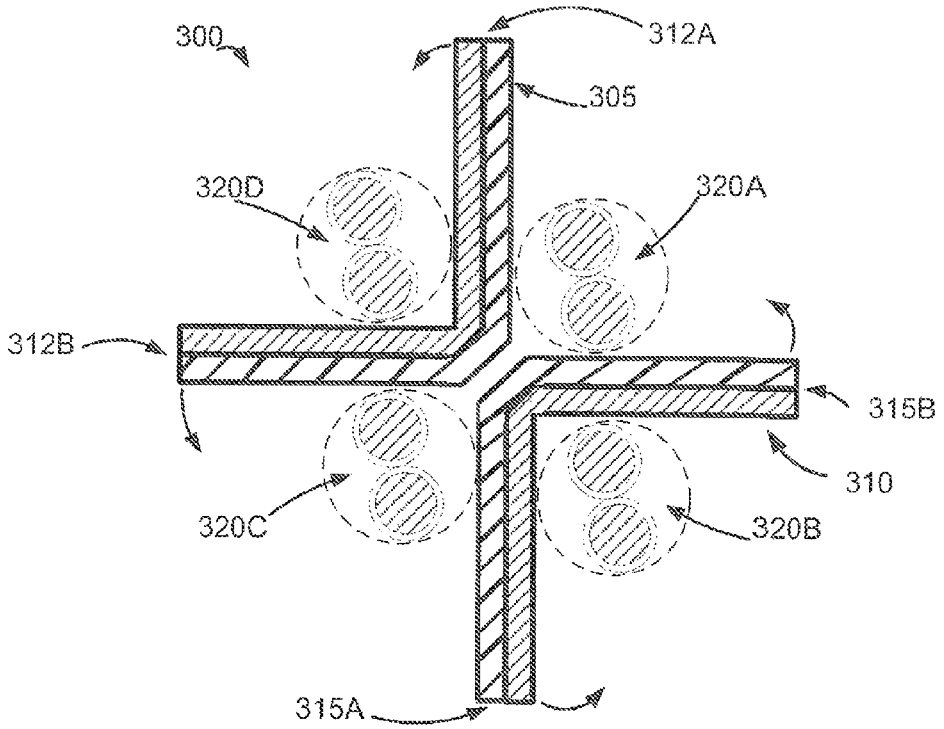
Figure 3B:
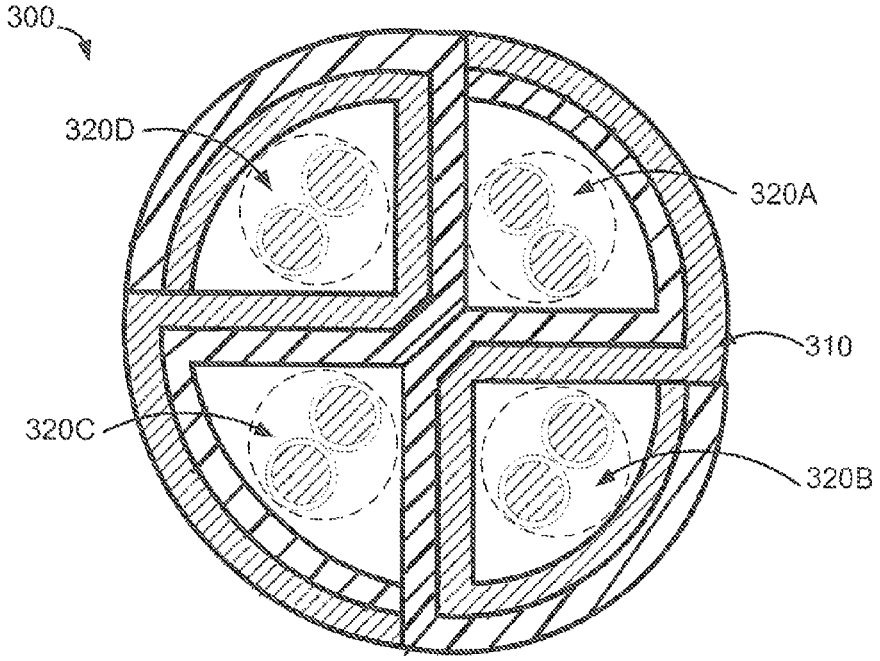

FIGS. 3A and 3B illustrate another example separator 300 that may be formed from two tapes 305, 310. The separator 300 may include similar components as the separator 200 described above with reference to FIGS. 2A and 2B. Accordingly, each tape 305, 310 may include respective widthwise edges 312A, 312B, 315A, 315B that are positioned beyond an outer periphery of a plurality of twisted pairs 320A-D such that the tapes 305, 310 include extending portions. Additionally, the extending portions may be wrapped or curled around the outer periphery in order to form an outer shield around the twisted pairs 320A-D.

However, in contrast to the separator 200 illustrated in FIGS. 2A and 2B, the tapes 305, 310 of the separator 300 illustrated in FIGS. 3A and 3B may not be bonded together between the twisted pairs 320A-D. For example, no longitudinally extending bonding line may be formed at a position between the twisted pairs 320A-D and/or at a position proximate to longitudinally extending folds formed in the tapes 305, 310. Instead, the two tapes 305, 310 may be positioned proximate to one another between the twisted pairs 320A-D, and the two tapes 305, 310 may then be held in place by the twisted pairs 320A-D. For example, the two tapes 305, 310 may be helically twisted with the twisted pairs 320A-D and, as a result of the twisting operation, the twisted pairs 320A-D may exert a sufficient force to hold the two tapes 305, 310 in place. Additionally, in certain embodiments, an inner jacket, outer cable jacket, or other suitable covering, wrap, or binding layer formed around the separator 300 and the twisted pairs 320A-D may assist in holding the two tapes 305, 310 in place.

Figure 4:
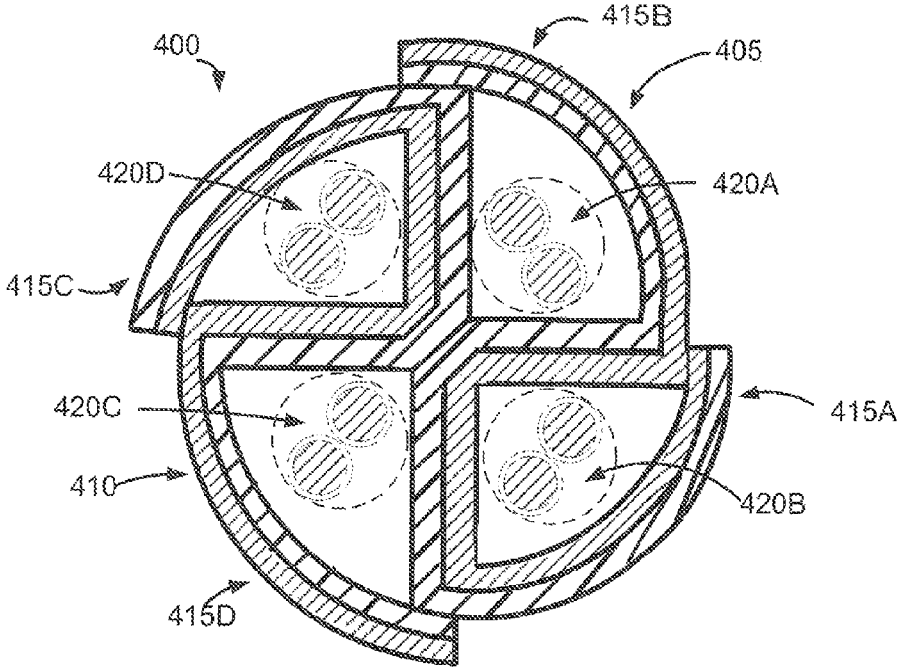

In certain embodiments, an extending portion of a separator may overlap another portion of the separator (e.g., another extending portion, etc.) when it is wrapped around an outer periphery of a plurality of twisted pairs. In this regard, gaps or spaces may be reduced or eliminated in an outer shield formed by the separator. FIG. 4 illustrates an example separator 400 in which overlaps are formed by extending portions. The separator 400 may include similar components as those discussed above with reference to FIGS. 2A-3B. For example, the separator 400 may include two tapes 405, 410 that each include a longitudinally extending fold positioned between a plurality of twisted pairs 420A-D. Additionally, each of the tapes 405, 410 may include extending portions that are wrapped or curled around an outer periphery of the twisted pairs 420A-D. For example, a first tape 405 may include a first extending portion 415A and a second extending portion 415B. Similarly, a second tape 410 may include a third extending portion 415C and a fourth extending portion 415D.

When each of the extending portions 415A-D is wrapped around the outer periphery, a respective overlap may be formed with an adjacent extending portion. For example, the first extending portion 415A may overlap the second extending portion 415B, the second extending portion 415B may overlap the third extending portion 415C, the third extending portion 415C may overlap the fourth extending portion 415D, and the fourth extending portion 415D may overlap the first extending portion 415A. As desired in various embodiments, any suitable degree or distance of overlap may be formed. For example, an overlap of approximately 10° (as measured around the circumference of the twisted pairs), 15°, 20°, 25°, 30°, 35°, 40°, an overlap included in a range between any two of the above values, or an overlap included in a range bounded on either a minimum or maximum end by one of the above values may be formed.

Additionally, as set forth in greater detail above with reference to FIGS. 2A and 2B, an overlapping portion may be bounded to an underlying portion utilizing a wide variety of suitable methods and/or techniques.

Figure 5:
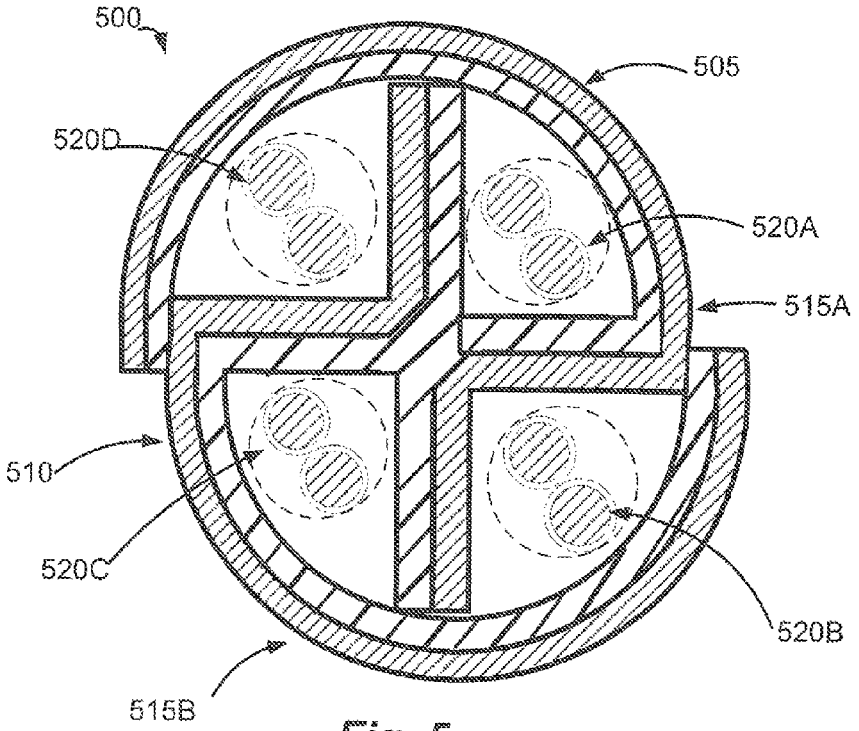

Although FIGS. 2A-4 illustrated example separators in which both tapes extend beyond an outer periphery of a plurality of twisted pairs along both widthwise edges, in other embodiments, one or both tapes may only extend beyond an outer periphery along a single edge. FIG. 5 illustrates an example separator 500 in which each tape includes a single extending portion. The separator 500 may include two tapes 505, 510 that each include a longitudinally extending fold positioned between a plurality of twisted pairs 520A-D. Each of the tapes 505, 510 may include a wide variety of suitable constructions, layers, and/or dimensions. As shown, each of the tapes 505, 510 may include a single portion that extends beyond an outer periphery of the twisted pairs 520A-D. For example, the first tape 505 may have a first widthwise edge that does not extend beyond the twisted pairs 520A-D and a second widthwise edge positioned at the end of a first extending portion 515A. Similarly, the second tape 510 may have a first widthwise edge that does not extend beyond the twisted pairs 520A-D and a second widthwise edge positioned at the end of a second extending portion 515B.

The two extending portions 515A, 515B may be wrapped or curled around the outer periphery of the twisted pairs 520A-D in order to form an outer shield. As shown, each extending portion 515A, 515B may extend at least approximately 180° around the outer periphery. As desired, an overlap may be formed between an extending portion and an underlying portion of the separator 500 (e.g., an underlying extending portion) when the extending portion is wrapped around the outer periphery. As set forth in greater detail above, any desired amount of overlap may be formed. Additionally, in certain embodiments, an overlapping portion may be bonded to an underlying portion utilizing a wide variety of suitable methods and/or techniques.

Figure 6:
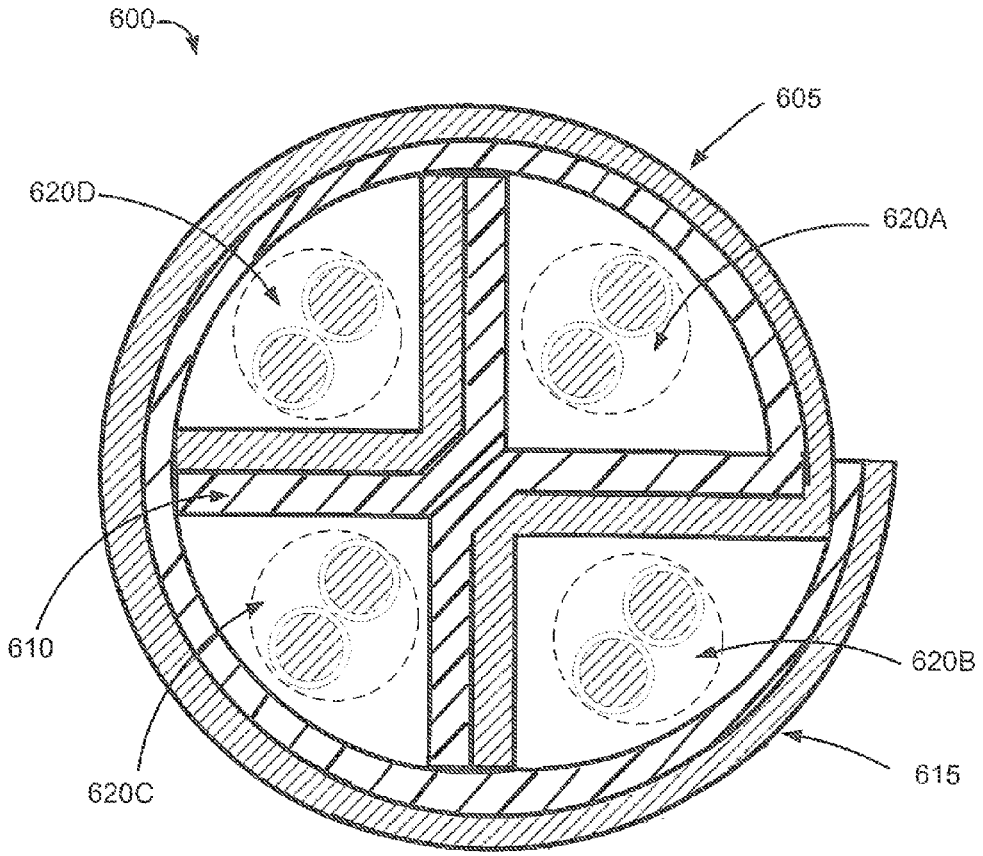

FIG. 6 illustrates an example separator 600 in which a single tape includes an extending portion. The separator 600 may include two tapes 605, 610 that each include a longitudinally extending fold positioned between a plurality of twisted pairs 620A-D. Each of the tapes 605, 610 may include a wide variety of suitable constructions, layers, and/or dimensions. As shown, a first tape 605 may include a single portion 615 that extends beyond an outer periphery of the twisted pairs 620A-D. For example, the first tape 605 may have a first widthwise edge that does not extend beyond the twisted pairs 620A-D and a second widthwise edge positioned at the end of an extending portion 615. The second tape 610 may have two widthwise edges that do not extend beyond the twisted pairs 620A-D.

The extending portion 615 may be wrapped or curled around the outer periphery of the twisted pairs 620A-D in order to form an outer shield. As shown, the extending portion 615 may extend at least approximately 360° around or completely around the outer periphery. As desired, an overlap may be formed between the extending portion and an underlying portion of the separator 600 (e.g., another section of the extending portion 615) when the extending portion is wrapped around the outer periphery. As set forth in greater detail above, any desired amount of overlap may be formed. For example, the extending portion 615 may be wrapped once, twice, or any other number of times around the outer periphery. Additionally, in certain embodiments, an overlapping portion may be bonded to an underlying portion utilizing a wide variety of suitable methods and/or techniques.

In certain embodiments, when an extending portion is wrapped around an outer periphery of a plurality of twisted pairs, such as in the embodiments illustrated in FIGS. 2A-6 discussed above in in FIGS. 7D and 8E discussed below, one or more patches incorporated into a separator may be electrically shorted or continuous along a circumferential direction. For example, when one or more extending portions are wrapped around an outer periphery, the patch(es) of shielding material may contact one another at or near the edges of the extending portion(s). In this regard, the shorted patch(es) may create a continuous expanse of shielding material in a circumferential direction or along a periphery of an outer shield. As a result, electrical perturbations may be reduced relative to conventional cables, which may permit signal leakage at overlap or circumferential edge portions. Therefore, a cable incorporating a separator may exhibit improved electrical performance, such as reduced return loss and/or reduced cross-talk loss.

Figure 7A:
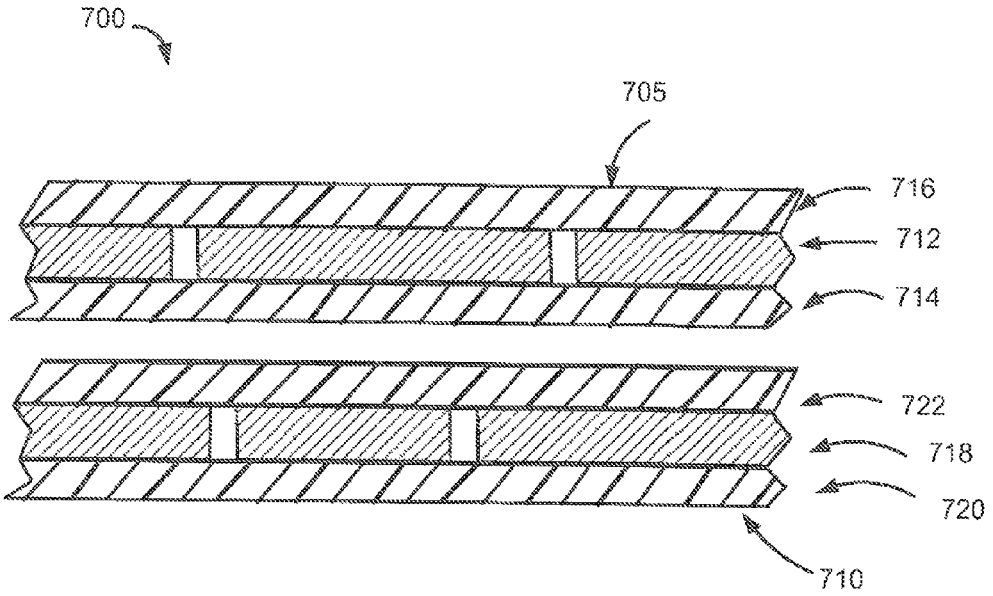
FIGS. 7A and 7B respectively illustrate side and cross-sectional views of two alternative example tape structures that may be utilized to form a separator structure, according to an illustrative embodiment of the disclosure.
Figure 7B:
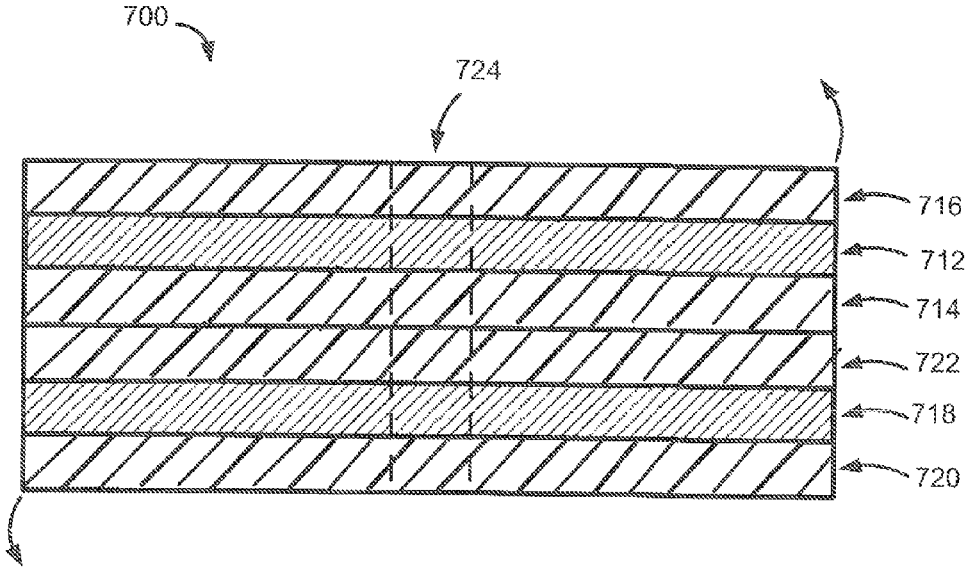

The tape and separator structures illustrated in FIGS. 1A-6 all depict tapes that include a single layer of shielding material formed on a base dielectric layer. As mentioned above, a wide variety of other suitable tape constructions may be utilized. A few alternative tape structures are discussed below with reference to FIGS. 7A-8E. Turning first to FIGS. 7A and 7B, which respectively illustrate side and cross-sectional views of two tapes, a separator 700 may be formed from two tapes 705, 710 that include a layer of shielding material sandwiched between two layers of dielectric material. For example, a first tape 705 may include a layer of shielding material 712 that is sandwiched between two layers of dielectric material 714, 716. Similarly, a second tape 710 may include a layer of shielding material 718 that is sandwiched between two layers of dielectric material 720, 722. Each of the layers may be formed from a wide variety of suitable materials and/or may have a wide variety of suitable dimensions, as set forth in greater detail above with reference to FIGS. 1A-6. Additionally, in certain embodiments, the tapes 705, 710 may be optionally bonded together, for example, along at least one or more portions of a longitudinally extending line 724.

Similar to the separator structures described above, a longitudinal fold may be formed in each of the tapes 705, 710 such that each tape forms two respective prongs of a separator 700. For example, as shown in FIG. 7B, a first edge of a first tape 705 may be folded in a first direction, and an opposite edge of the second tape 710 may be folded in an opposite direction. As set forth above, a wide variety of suitable methods and/or techniques may be utilized to fold the tapes 705, 710. Additionally, the tapes 705, 710 may be folded after they are bonded together, before they are bonded together, or without being bonded together.

Figure 7C:
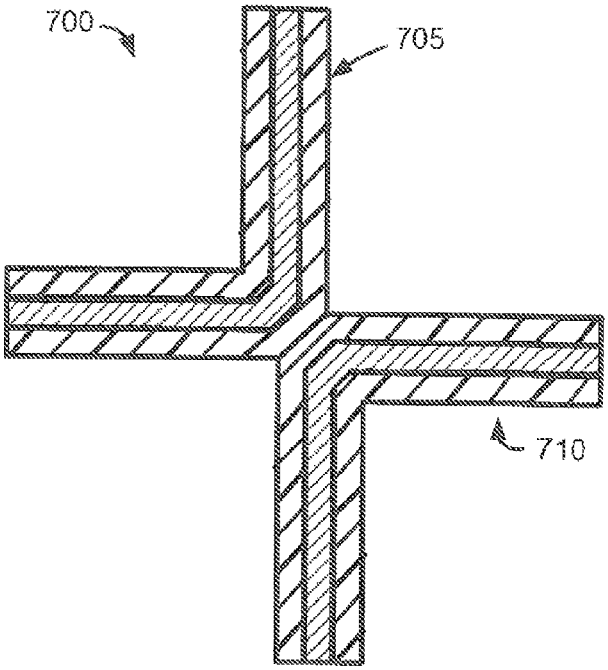
FIGS. 7C and 7D are cross-sectional views of example separator structures that may be formed utilizing the example tape structures illustrated in FIGS. 7A and 7B.
Figure 7D:
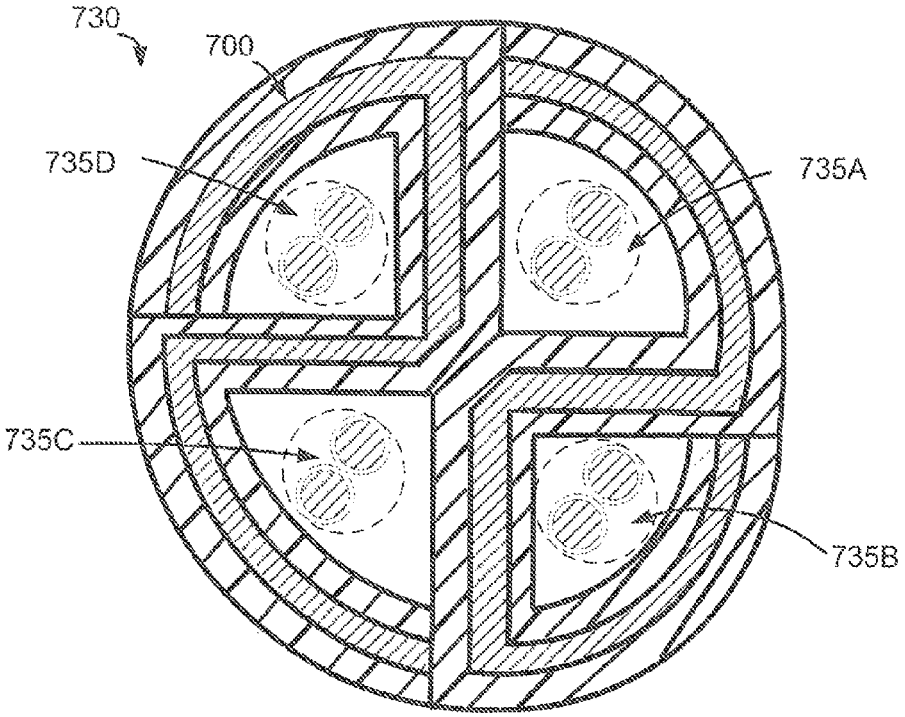

FIG. 7C illustrates a cross-sectional view of an example separator 700 formed from the two tapes 705, 710 illustrated in FIGS. 7A and 7B. As desired, the separator 700 may be positioned between a plurality of twisted pairs. The presence of two dielectric layers formed around each layer of shielding material may result in a relative uniform spacing or distance between each twisted pair and shielding material, which may improve signal performance. Additionally, in certain embodiments, the prongs of the separator 700 may not extend beyond an outer periphery of the twisted pairs. In other embodiments, one or more prongs may extend beyond the outer periphery. FIG. 7D illustrates a cross-sectional view of example twisted pair component 730 in which the separator 700 is positioned between a plurality of twisted pairs 735A-D and further includes extending portions that are wrapped around an outer periphery of the twisted pairs 735A-D in order to form an outer shield. As set forth above, any number of prongs may extend beyond the outer periphery. Additionally, as desired in various embodiments, overlapping portions may be formed by extending prongs and/or one or more prongs may be bonded to underlying layers.

Figure 8A:
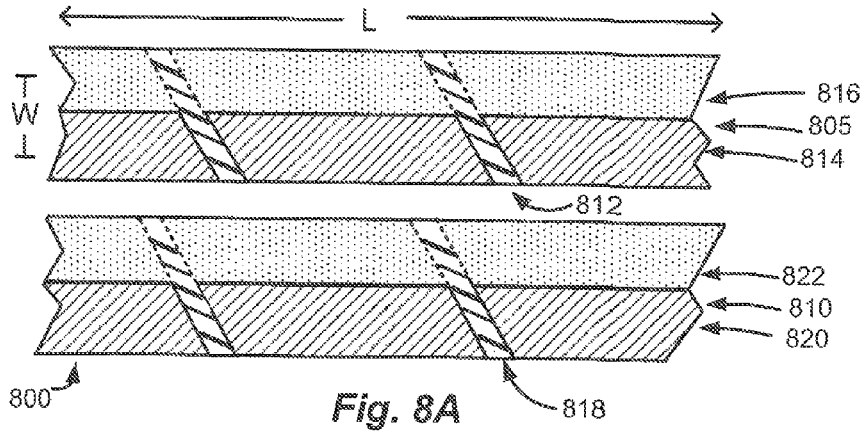
FIGS. 8A-C respectively illustrate top level, side, and cross-sectional views of two alternative example tape structures that may be utilized to form a separator structure, according to an illustrative embodiment of the disclosure.
Figure 8B:
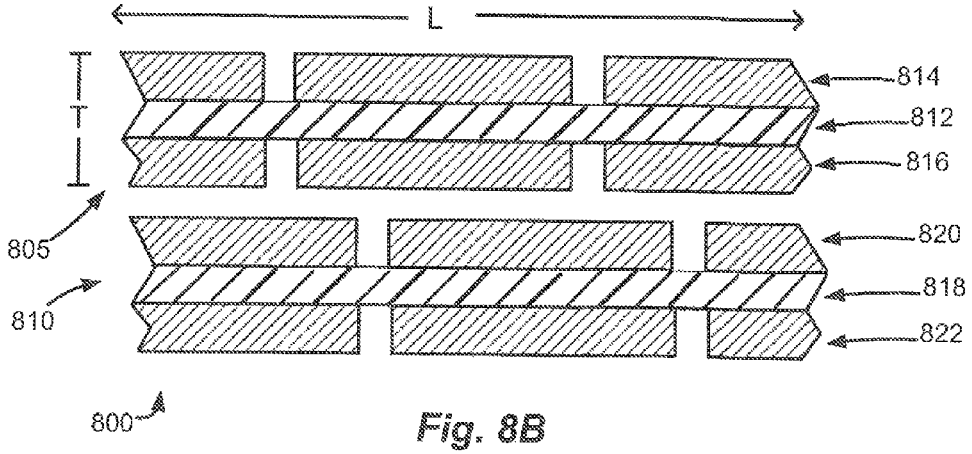
Figure 8C:
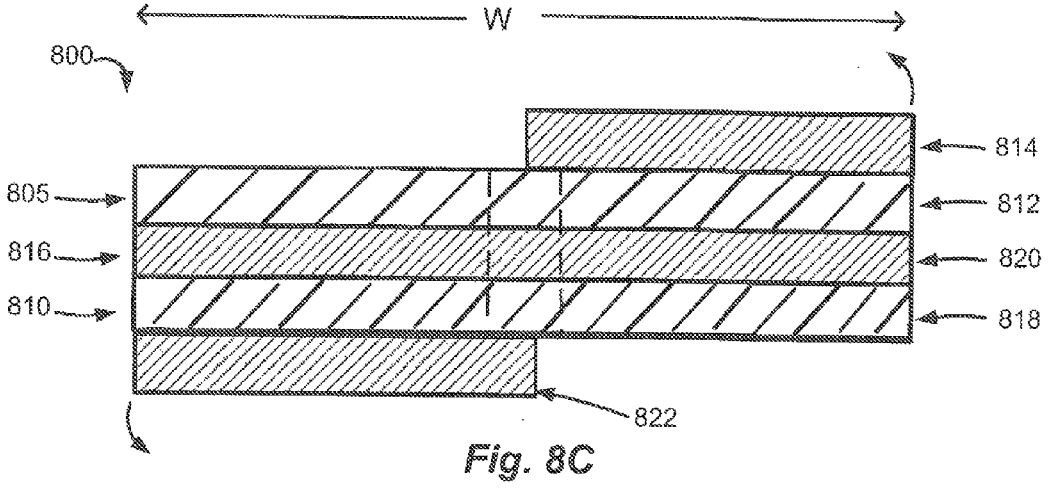

FIGS. 8A-C respectively illustrate top level, side, and cross-sectional views of two alternative example tape structures 805, 810 that may be utilized to form a separator structure 800, according to an illustrative embodiment of the disclosure. Each tape 805, 810 may include a layer of dielectric material with a respective layer of shielding material formed on opposite sides of the dielectric material. For example, a first tape 805 may include a layer of dielectric material 812, a first layer of shielding material 814 formed on one side or surface of the dielectric layer 812, and a second layer of shielding material 816 formed on an opposite side or surface of the dielectric layer 812. Similarly, a second tape 810 may include a layer of dielectric material 818, a first layer of shielding material 820 formed on one side or surface of the dielectric layer 818, and a second layer of shielding material 82 formed on an opposite side or surface of the dielectric layer 818. Additionally layers may be incorporated into a tape as desired. Each of the layers may be formed from a wide variety of suitable materials and/or may have a wide variety of suitable dimensions, as set forth in greater detail above with reference to FIGS. 1A-6.

In certain embodiments, the layers of shielding material incorporated into a tape may extend substantially across a widthwise dimension of the dielectric layer. In other embodiments, as shown in FIGS. 8A-C, each layer of shielding material may have a width that is less than that of a dielectric layer. Each of the layers of shielding material may have any suitable width. For example, each of the layers of shielding material may have a width that corresponds to the length of a separator prong formed by a tape. In one example embodiment, when a tape (e.g., tape 805) is longitudinally folded, the tape may form two prongs of a separator 800. Each prong may have a layer of shielding material formed on it, and the layers of shielding material may be formed on opposite sides of a base dielectric layer 812.

In certain embodiments, the tapes 805, 810 may be bonded together, for example, along at least one or more portions of a longitudinally extending line. In other embodiments, the tapes 805, 810 may be positioned between a plurality of twisted pairs without being bonded together. Additionally, similar to the separator structures described above, a longitudinal fold may be formed in each of the tapes 805, 810 such that each tape forms two respective prongs of a separator 800. For example, as shown in FIG. 8C, a first edge of a first tape 805 may be folded in a first direction, and an opposite edge of the second tape 810 may be folded in an opposite direction. As set forth above, a wide variety of suitable methods and/or techniques may be utilized to fold the tapes 805, 810. Additionally, the tapes 805, 810 may be folded after they are bonded together, before they are bonded together, or without being bonded together.

Figure 8D:
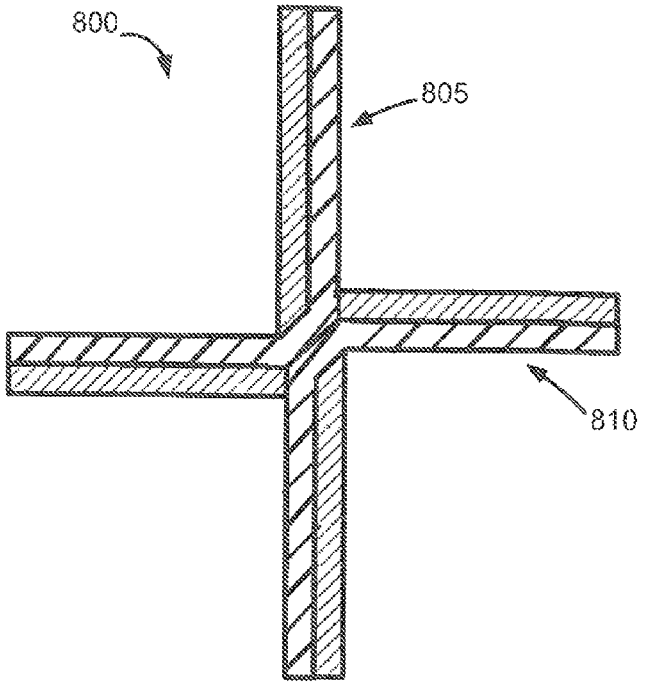
FIGS. 8D and 8E are cross-sectional views of example separator structures that may be formed utilizing the example tape structures illustrated in FIGS. 8A-C.

FIG. 8D illustrates a cross-sectional view of an example separator 800 formed from the two tapes 805, 810 illustrated in FIGS. 8A-C. As desired, the separator 800 may be positioned between a plurality of twisted pairs. Additionally, in certain embodiments, the prongs of the separator 800 may not extend beyond an outer periphery of the twisted pairs. In other embodiments, one or more prongs may extend beyond the outer periphery. As a result of forming shielding layers on opposite sides of a dielectric layer, each shielding layer may be oriented in the same direction relative to a twisted pair positioned adjacent to the separator 800. In other words, each twisted pair may be positioned adjacent to a single layer of shielding material. By contrast, in the separator embodiments illustrated in FIGS. 1A-6, two of the twisted pairs are adjacent to shielding material while the other two twisted pairs are adjacent to dielectric material. It may be possible to achieve improved signal performance by forming shielding material on opposite sides of a dielectric layer.

Figure 8E:
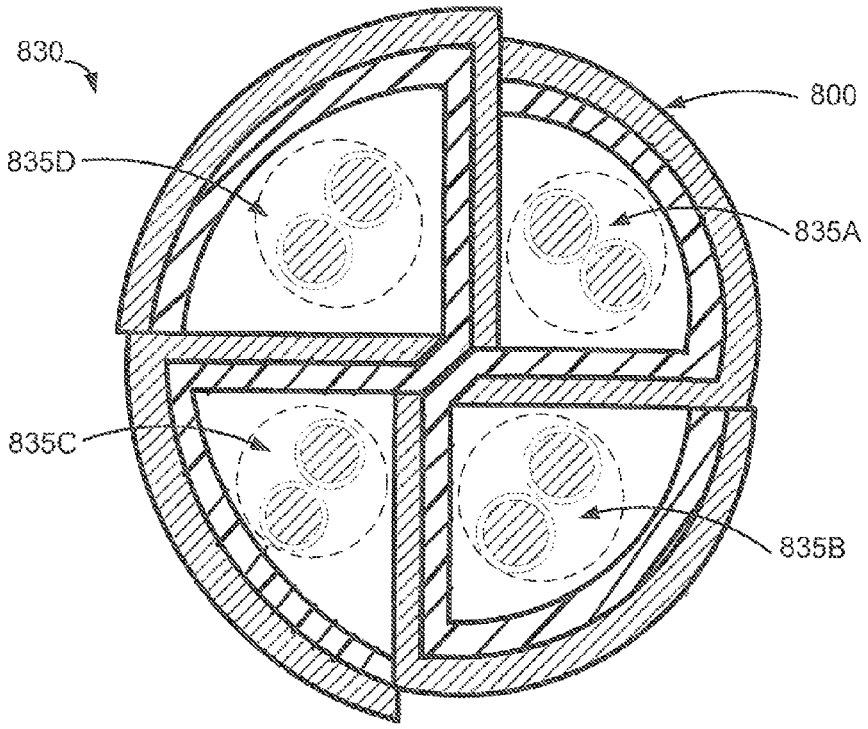

FIG. 8E illustrates a cross-sectional view of example twisted pair component 830 in which the separator 800 is positioned between a plurality of twisted pairs 835A-D and further includes extending portions that are wrapped around an outer periphery of the twisted pairs 835A-D in order to form an outer shield. The arrangement of the shielding layers illustrated in FIG. 8E is opposite to that shown in FIG. 8D. In other words, if FIG. 8D includes tapes with a first layer of shielding material formed on a top surface and a second layer of shielding material formed on a bottom surface of a dielectric layer, then the tapes utilized to form the separator 800 of FIG. 8E would have a reversed arrangement.

As set forth above, any number of prongs may extend beyond the outer periphery. Additionally, as desired in various embodiments, overlapping portions may be formed by extending prongs and/or one or more prongs may be bonded to underlying layers. Further, the arrangement of shielding material in the separator 800 of FIG. 8E may result in the formation of an outer shield in which shielding material is incorporated into an outer layer of the shield. In other words, the dielectric layer of the outer shield may be positioned adjacent to the twisted pairs 835A-D, and the shielding material may be formed on an opposite side of the dielectric layer. Such an arrangement may result in improved electrical performance of the twisted pair component 830. In other embodiments, an outer shield may be formed in which shielding material is adjacent to the twisted pairs 835A-D.

A wide variety of other types of separator structures may be formed as desired in various embodiments. These separators may include any number of layers of material. Additionally, as desired, separators may be formed with a wide variety of suitable dimensions and/or configurations. For example, various components of a separator may have any suitable widths and/or thicknesses. Further, any of the features discussed above for a given separator structure may be incorporated into any of the other separator structures. The separators structures illustrated in FIGS. 1A-8E are provided by way of non-limiting example only.

Figure 9A:
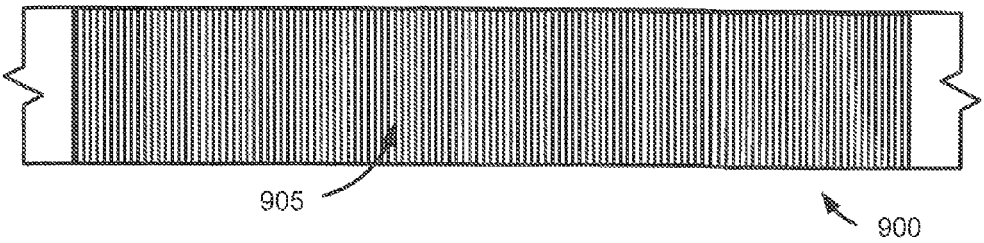
FIGS. 9A-9G are top level views of various configurations of electrically conductive material that may be incorporated into separator structures as desired in various embodiments of the disclosure.

As set forth above, a wide variety of different shielding configurations and/or arrangements of shielding material may be utilized in conjunction with separators, such as any of the separators illustrated in FIGS. 1A-8E. FIGS. 9A-9G illustrate top level views of example shielding material configurations that may be utilized in various embodiments. These configurations are applicable to any layer of shielding material formed on a tape that is utilized in a separator structure. With reference to FIG. 9A, an example tape 900 (or shield layer incorporated into a tape) may include relatively continuous shielding material 905. For example, a continuous patch of shielding material may be formed on a dielectric layer. As another example, a tape may be formed from a shielding material or impregnated with shielding material along its entire length.

Figure 9B:
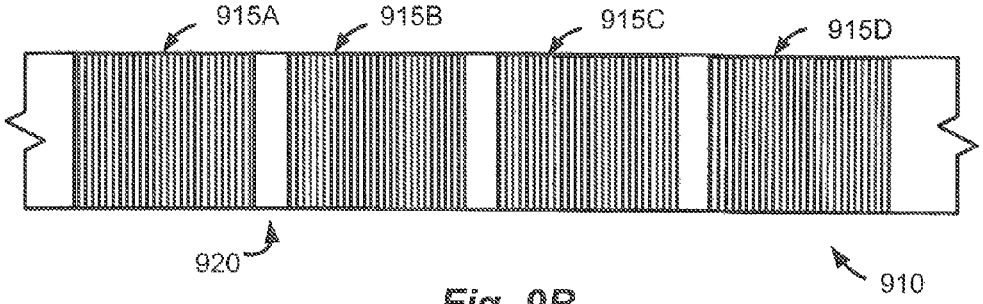

With reference to FIG. 9B, a top level view of another example tape 910 (or shield layer) is illustrated. The tape 910 may include any number of rectangular patches of shielding material, such as patches 915A-D formed on a dielectric material or otherwise incorporated into the tape. As desired in various embodiments, the patches 915A-D may include any desired lengths, and any desired gap 920 or separation distance may be provided between adjacent patches. In certain embodiments, the patches may be formed in accordance with a repeating pattern having a definite step or period. As desired, additional patches may be formed on an opposing side of the dielectric material to cover the gaps 920.

Figure 9C:
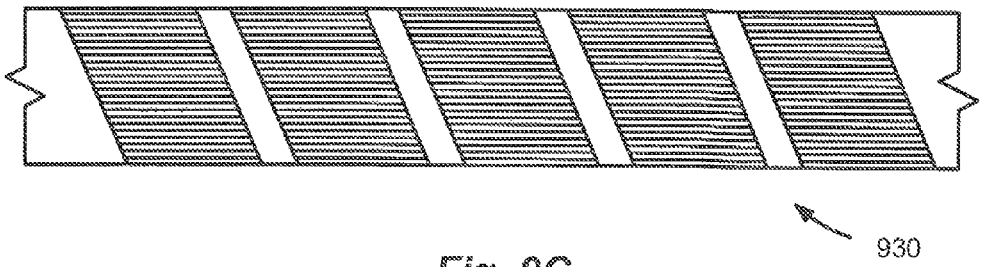
Figure 9D:
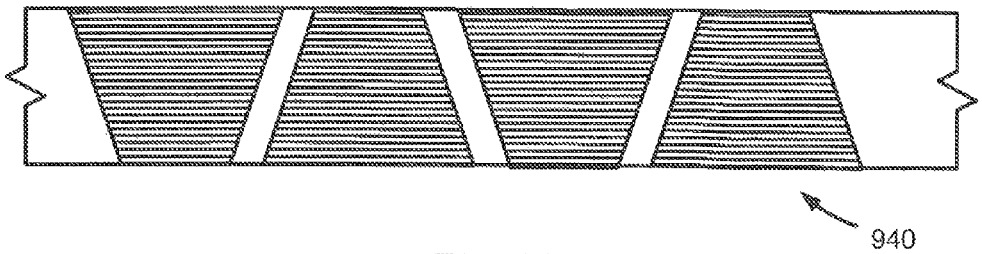

FIG. 9C illustrates a top level view of another example tape 930 (or shield layer formed on a tape). The tape 930 may include any number of patches of shielding material having the shape of a parallelogram. In other words, the patches may be formed at an angle within one or more areas of the tape 930. As shown, the patches may be formed at an acute angle with respect to the width dimension of the tape 930. In certain embodiments, the acute angle facilitates manufacturing and/or enhances patch-to-substrate adhesion. Additionally, the acute angle may also facilitate the covering of opposing isolating spaces or gaps. In certain embodiments, benefit may be achieved when the acute angle is about 45 degrees or less. In other embodiments, benefit is achieved when the acute angle is about 35 degrees or less, about 30 degrees or less, about 25 degrees or less, about 20 degrees or less, or about 15 degrees or less. In other embodiments, benefit is achieved when the acute angle is between about 12 and about 40 degrees. In certain embodiments, the acute angle may be in a range between any two of the degree values provided in this paragraph or a range bounded on a minimum or maximum end by one of the provided values. FIG. 9D illustrates a top level view of another example tape 940 (or shield layer formed on a tape) that may be utilized in various embodiments. The tape 940 may include any number of patches of shielding material having a trapezoidal shape. In certain embodiments, the orientation of adjacent trapezoidal patches may alternate. Similar to the patch pattern illustrated in FIG. 9C, the trapezoidal patches may provide manufacturing and/or shielding benefits.

Figure 9E:
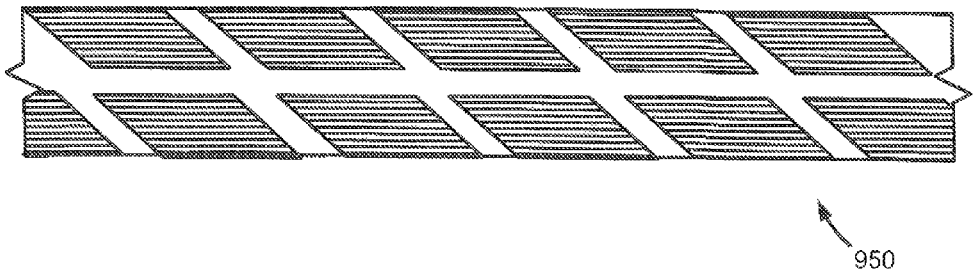

In certain embodiments, patches of shielding material may be formed across a dimension of a tape, such as across a width dimension that is perpendicular to a longitudinally extending direction of the tape. In other embodiments, multiple patches may be formed across a given dimension, such as a width dimension. Similarly, multiple patches may be formed within any given shield layer incorporated into a tape. FIG. 9E illustrates a top level view of an example tape 950 (or shield layer) in which multiple patches are formed across a width dimension. As desired, patches may be discrete or discontinuous along any dimension of the tape 950 and/or across multiple dimensions (e.g., a width and a length dimension). Additionally, any number of patches may be formed across a given dimension. Each patch may have a wide variety of suitable dimensions (e.g., widths, lengths, etc.), and/or a wide variety of suitable separation gaps may be formed between adjacent patches.

Figure 9F:
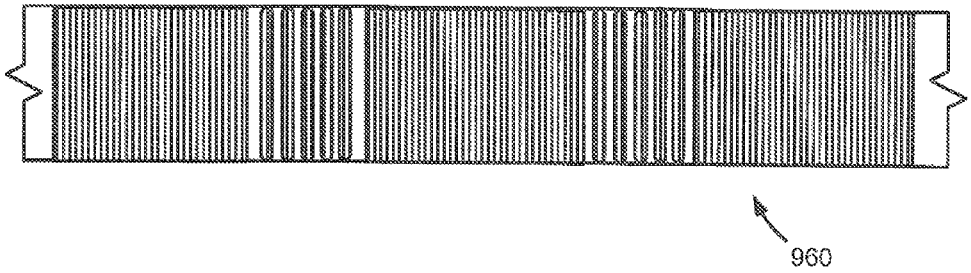

FIG. 9F illustrates a top level view of an example tape 960 (or shield layer) in which one or more respective microcuts are utilized to form gaps between adjacent patches of shielding material. In certain embodiments, the width of each of these microcuts may be less than or equal to approximately 0.25 mm. These relatively narrow microcuts may limit the leakage of the shield layer, and therefore, reduce noise during electrical transmission using a cable. In certain embodiments, a series of microcuts may be placed in relatively close proximity to one another. For example, a series of microcuts may be formed as an alternative to a traditional space or gap between patches of shielding material. As one example, a conventional discontinuous shield may include gaps or spaces between adjacent patches that are at least approximately 0.050 inches (approximately 1.27 mm) wide. By contrast, a plurality of relatively narrow or fine microcuts (e.g., microcuts of approximately 0.25 mm, etc.) may be formed in an approximately 0.050 inch wide portion (or any other desired width) of a tape or shield layer. Additionally, it is noted that the use of singular or isolated microcuts within a shield layer may allow electricity to arc across the microcuts, thereby leading to a safety hazard. However, a plurality of microcuts positioned or formed in relatively close proximity to one another may limit safety risks due to electrical arcing. Any electrical arcing across the microcut gaps will likely burn up or destroy the electrically conductive material between the closely spaced microcuts, thereby breaking or severing the electrical continuity of the shield layer and preventing current from propagating down the shield layer. In other words, the microcuts may be spaced and/or formed to result in a shield layer that includes shielding material having a sufficiently low mass such that the shielding material will fuse or melt when current is applied.

Although the examples above describe situations in which conventional spaces or gaps are respectively replaced with a series of microcuts, a wide variety of other suitable configurations of microcuts may be utilized in other embodiments. For example, a tape or shield layer may include microcuts continuously spaced in close proximity to one another along a longitudinal length. In other embodiments, sections or patches of microcuts may be spaced at regular intervals or in accordance with any desired pattern. Each section or patch may include at least two microcuts. A wide variety of suitable patterns may be formed by microcuts. For example, a section of microcuts (e.g., one section of a repeating pattern, etc.) may include microcuts having a perpendicular line pattern, a dashed vertical line pattern, a square pattern, an inverse square pattern, a diamond-shaped pattern, an inverse diamond-shaped pattern, a checkerboard pattern, an angled line pattern, a curved line pattern, or any other desired pattern. As another example, a section of microcuts may include microcuts that form one or more alphanumeric characters, graphics, and/or logos. In this regard, product identification information, manufacturer identification information, safety instructions, and/or other desired information may be displayed on a shield layer. In yet other embodiments, sections or patches of microcuts may be positioned in random locations along a shield layer. Additionally, a wide variety of suitable methods and/or techniques may be utilized to form microcuts. For example, one or more lasers may be utilized to form microcuts.

Figure 9G:
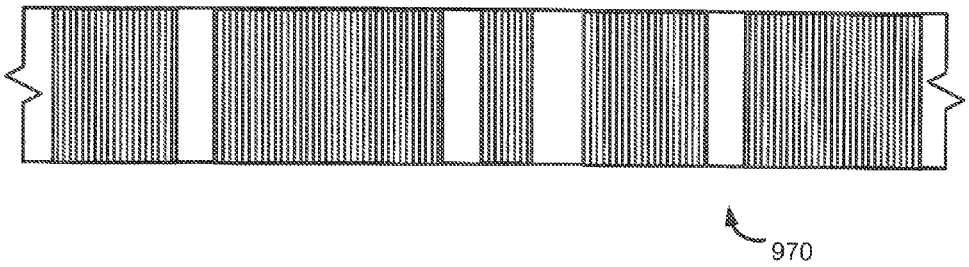

FIG. 9G depicts a top level view of another example tape 970 (or shield layer) that may be utilized in various embodiments. The tape 970 may include a plurality of discontinuous patches or sections of shielding material that are formed in a random or pseudo-random manner. A wide variety of other suitable patch configurations and/or other configurations of shielding material may be utilized as desired in other embodiments, and the configurations discussed herein are provided by way of non-limiting example only.

Example System for Forming Separator Structures

Figure 10:
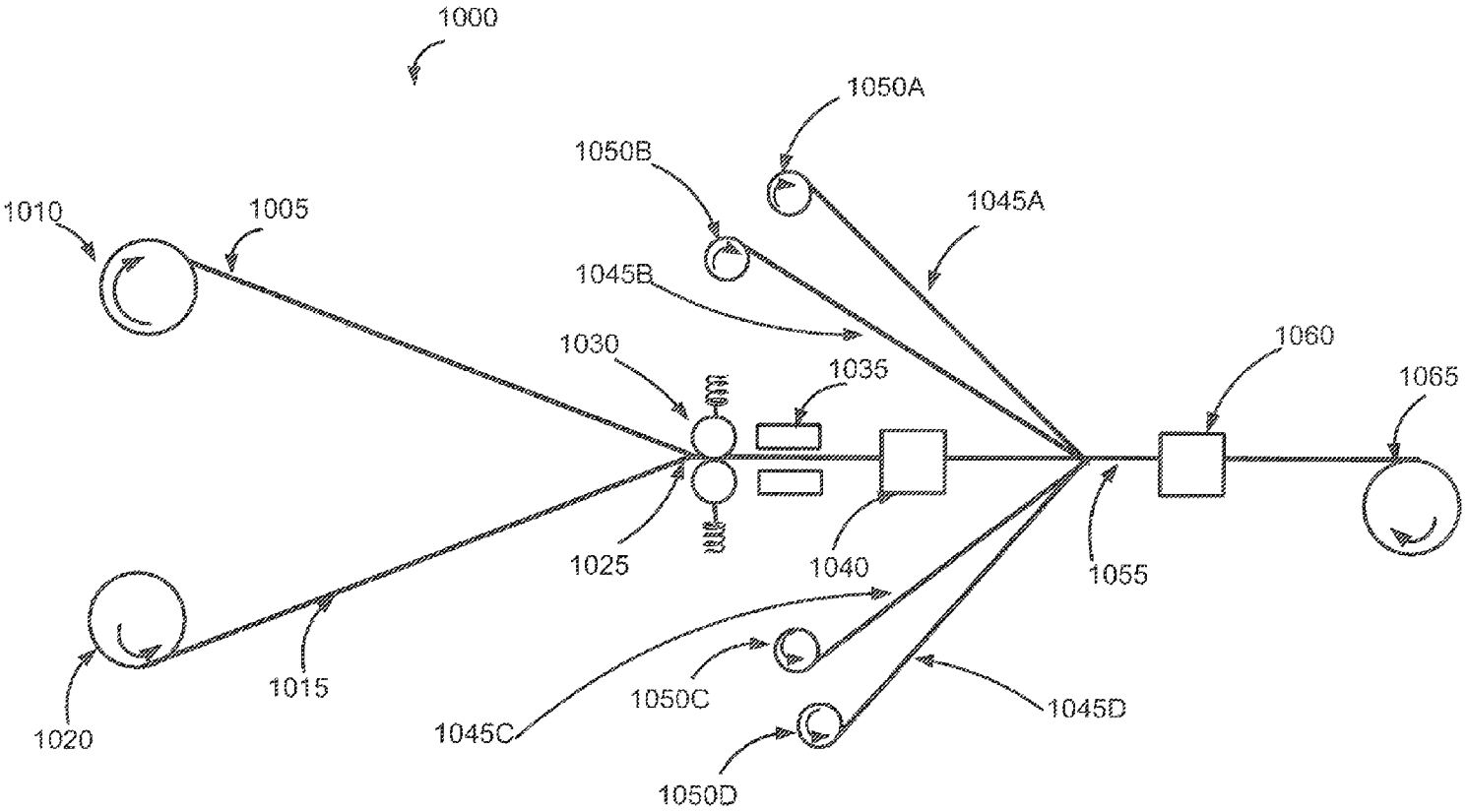
FIG. 10 is a block diagram of an example system that may be utilized to form a separator structure and/or to incorporate the separator structure into a cable, according to an illustrative embodiment of the disclosure.

FIG. 10 is a block diagram of an example system 1000 that may be utilized to manufacture or form a separator structure, according to an illustrative embodiment of the disclosure. The example system 1000 may be utilized to form a wide variety of suitable separators, such as any of the separator described above with reference to FIGS. 1A-8E. With reference to the FIG. 10, a first tape 1005 may be provided from a first source 1010, and a second tape 1015 may be provided from a second source 1020. A wide variety of suitable types of tapes may be provided by each source 1010, 1020, such as any of the tapes or tape structures discussed above. In certain embodiments, the sources 1010, 1020 may be, for example, suitable bins or reels of material that includes a suitable payoff that provides a tape downstream to other components of the system 1000. In other words, each source may provide preformed or prefabricated tapes. In other embodiments, suitable tapes may be manufactured or constructed in an in-line manner and provided downstream to other components of the system 1000.

In certain embodiments, the two tapes 1005, 1015 may be fed through the system 1000 to an accumulation point 1025. As desired, one or more suitable devices or components 1030 may apply pressure to the tapes 1005, 1015 in order to hold the two tapes together or position the tapes adjacent to one another. For example, one or more pressure rollers, spring-mounted rollers, or other suitable components may press the two tapes together.

Once they are brought together, the tapes 1005, 1015 may then be fed downstream to one or more suitable bonding devices 1035. The bonding devices 1035 may bond or join the tapes 1005, 1015 together along a longitudinally extending line or along portions of a longitudinally extending line. A wide variety of suitable bonding devices 1035 may be utilized as desired in various embodiments. For example, the bonding devices 1035 may include one or more ultrasonic welding devices. As another example, the bonding devices 1035 may include one or more suitable devices that apply mechanical fasteners to the tapes 1005, 1015, such as one or more devices that apply staples, rivets, pins, etc.

In other embodiments, one or more of the tapes 1005, 1015 may be provided to the bonding device(s) 1035 prior to the tapes 1005, 1015 being brought together. For example, the bonding devices 1035 may apply an adhesive, such as glue, epoxy, pressure sensitive adhesive, contact adhesive, thermoset adhesive, or radiation curable adhesive to one or both tapes 1005, 1015. The tapes 1005, 1015 may then be pressed together by the at an accumulation point. As desired in various embodiments, a bonding device 1035 may spray, wipe, or otherwise apply adhesive. In other embodiments, one or more tapes 1005, 1015 may already include applied adhesive that is covered by one or more disposable layers, such as removable paper or film layers, and the one or more bonding devices 1035 may be configured to remove the disposable layer(s).

Once bonded together, the tapes 1005, 1015 may be provided to one or more downstream devices 1040 that form longitudinally extending folds in the tapes 1005, 1015. In other embodiments, the two tapes 1005, 1015 may be longitudinally folded by one or more folding devices 1040 prior to being bonded together. In yet other embodiments, the two tapes 1005, 1015 may be provided directly to one or more folding devices 1040 without being bonded together by one or more bonding devices 1035. For example, the tapes 1005, 1015 may be individually folded, and the tapes may then be brought into proximity with one another in order to form a separator structure.

The one or more folding devices 1040 may include any suitable devices that are configured or operable to form respective longitudinally extending folds in each of the tapes 1005, 1015. For example, the folding devices 1040 may include one or more suitable folding dies configured to impart folds in the tapes 1005, 1015 as the tapes are passed through. In certain embodiments, a single die or set of dies may simultaneously fold both tapes 1005, 1015. In other embodiments, such as embodiments in which the tapes 1005, 1015 are folded prior to being brought together, separate dies or sets of dies may be utilized for each respective tape.

Following the folding of the two tapes 1005, 1015, the two folded tapes may be utilized as a separator structure within a twisted pair cable or twisted pair component. The tapes 1005, 1015 may be positioned between a plurality of twisted pairs, such as twisted pairs 1045A-D. The twisted pairs 1045A-D may be fed from respective twisted pair sources 1050A-D. The twisted pairs 1045A-D and the tapes 1005, 1015 may be fed to a suitable accumulation point 1055, such as an accumulation or bunching die, in which the twisted pairs are arranged or positioned adjacent to or in proximity to the tapes 1005, 1015. In certain embodiments, the twisted pair sources 1050A-D may include suitable bins, reels, spools, or other sources that provide previously assembly twisted pairs of conductors. In other embodiments, a portion or all of a twisted pair assembly process may be carried out in an in-line manner with the assembly and/or incorporation of the tapes 1005, 1015. For example, copper or other suitable conductors may be drawn to appropriate diameters, insulation may be formed around the conductors, and pairs of conductors may be twisted in order to form any number of twisted pairs. The pairs may then be fed in-line to the accumulation point 1055.

In certain embodiments, once the twisted pairs 1045A-D are positioned adjacent to the tapes 1005, 1015 or separator structure, one or more suitable folding or wrapping devices 1060 may be utilized to fold, curl, or wrap one or more portions of the tapes 1005, 1015 around an outer periphery of the twisted pairs. For example, in embodiments in which one or more prongs of a separator extend beyond an outer periphery of the plurality of twisted pairs, the extending portion(s) may be wrapped around the outer periphery in order to form an outer shield. A wide variety of suitable wrapping devices 1060 may be utilized as desired in various embodiments. For example, one or more suitable wrapping dies, funnels, or chutes may be configured to wrap or curl extending portions around the twisted pairs 1045A-D as the twisted pairs 1045A-D and tapes 1005, 1015 are passed through.

Additionally, in certain embodiments, the twisted pairs 1045A-D and the separator may be helically twisted together. For example, one or more suitable bunching devices may helically twist or bunch the plurality of twisted pairs 1045A-D together. The separator, which is positioned between the twisted pairs 1045A-D, may be twisted together with the pairs 1045A-D. In certain embodiments, when twisted, the separator may assist in maintaining the positions of the twisted pairs 1045A-D relative to one another and/or may assist in maintaining a desired spacing between the pairs 1045A-D. Additionally, in embodiments in which the tapes 1005, 1015 are not bonded together, the twisted pairs 1045A-D may assist in holding the tapes 1005, 1015 together.

As shown in FIG. 10, once the tapes 1005, 1015 have been positioned between and helically twisted with the twisted pairs 1045A-D and, in certain embodiments, extending portions of the tapes 1005, 1015 have been wrapped around the pairs 1045A-D, the resulting twisted pair component may be taken up for subsequent use and/or incorporation into a cable. For example, a suitable take-up device 1065, such as a take-up reel, may be utilized to collect the twisted pair component. In other embodiments, a suitable cover or binding layer may be formed around the twisted pair component. For example, one or more extrusion devices may be configured to extrude a jacket layer around the twisted pair component. As another example, one or more suitable devices may be configured to wrap a binder around the twisted pair component. As desired, the twisted pair component may be taken up after a suitable jacket, binder, or other outer layer is formed. In certain embodiments, the formation of a jacket may result in the completion of the assembly of a cable. Accordingly, a complete cable may be taken up or collected.

As an alternative to taking up a twisted pair component, in other embodiments, a twisted pair component may be provided downstream to one or more other suitable devices, components, and/or systems for further processing. For example, the twisted pair component may be incorporated into a larger cable structure, such as a cable that includes a plurality of twisted pair components or a composite cable that combines twisted pair components with other transmission media. Indeed, a wide variety of cable structures may be formed as desired.

As desired, one or more components of the system 1000 may be synchronized with one another and/or with one or more components of other systems (e.g., a system that manufactures tapes, a downstream cable assembly system, etc.). For example, a line speed of the system 1000 may be controlled such that it is approximately equal to the line speed of another system. In this regard, systems may be synchronized such that they can operate in a combined or in-lane manner. In other embodiments, the output of one or more systems may be taken up for subsequent provision to another system.

A wide variety of other components and/or devices may be incorporated into the system 1000 as desired in various embodiments. For example, any number of rollers and/or dancers be utilized to pull or otherwise advance materials (e.g., tapes, separator structures, twisted pairs, etc.) through the system 1000. Any number of motors or other drive components may be utilized to power various components of the system 1000 and/or to control line speed. As desired, the motors may be collectively or independently controlled by any number of suitable computing and/or control devices. In certain embodiments, the system 1000 may additional include one or more printing components or devices that are configured to print alphanumeric characters (e.g., text, a company name, etc.) and/or logos onto a separator, for example, on an outer shield formed by the separator. As desired, one or more optical recognition components may be utilized to identify suitable locations for printing.

Example Method for Forming Separator Structures

Figure 11:
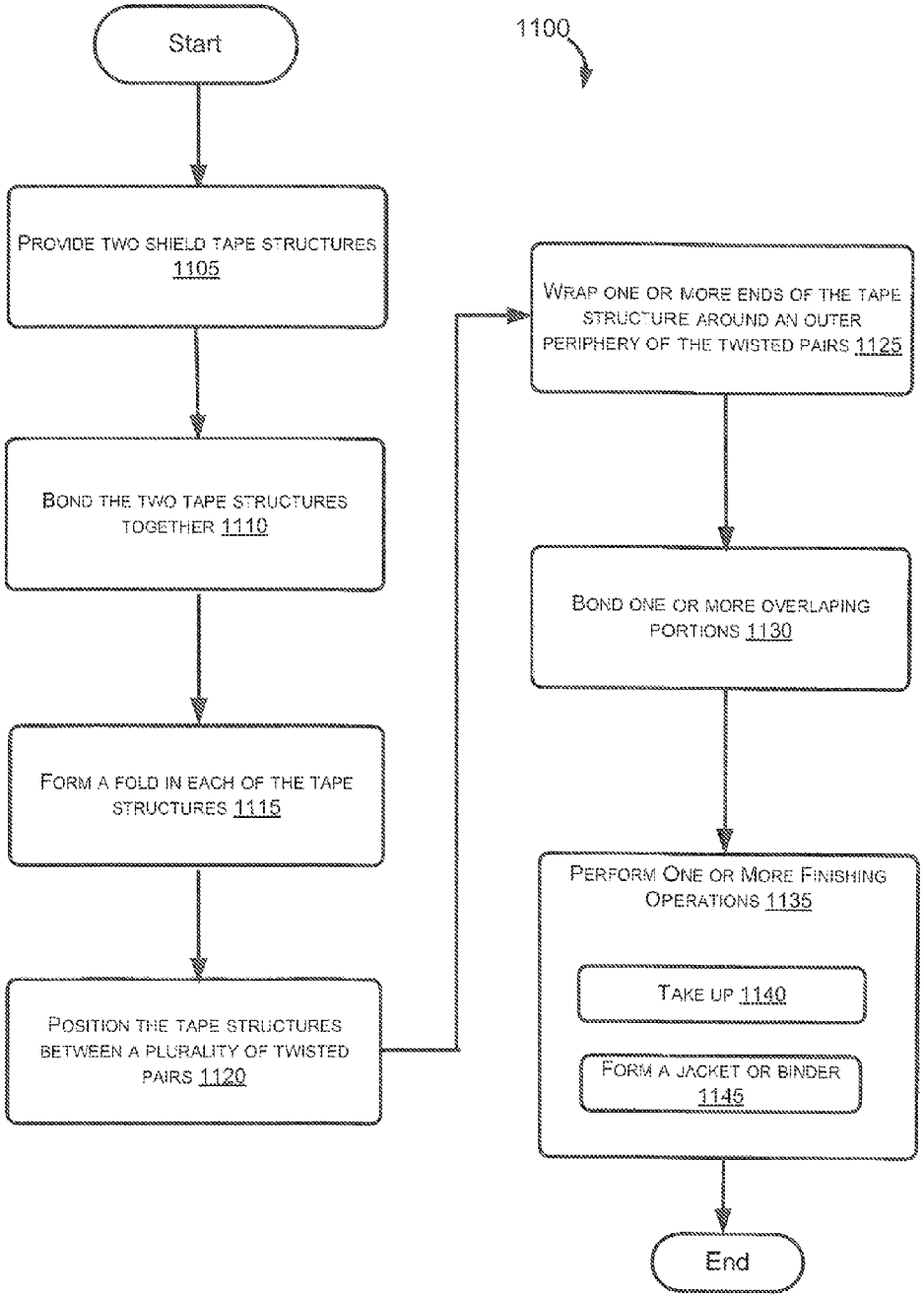
FIG. 11 is a flow diagram illustrating an example method for manufacturing or forming a separator structure in accordance with various embodiments of the disclosure.

FIG. 11 is a flow diagram illustrating an example method 1100 for manufacturing or forming a separator structure in accordance with various embodiments of the disclosure. Certain operations of the method 1100 may be performed by any number of suitable manufacturing systems, such as the system described above with reference to FIG. 10. The method 1100 may begin at block 1105.

At block 1105, two shield tape structures or tapes may be provided. A wide variety of suitable tapes may be provided as desired in various embodiments, such as any of the tapes discussed herein. Each tape may be formed from any suitable materials and/or may have a wide variety of suitable constructions, layers, and/or dimensions. In certain embodiments, the provided tapes may be preformed or previously manufactured tapes. In other embodiments, one or more tapes may be constructed or assembled at block 1105.

At block 1110 which may be optional in certain embodiments, the two tapes may be bonded or joined together. For example, the two tapes may be bonded along at least portions of a longitudinally extending line. As set forth above, a wide variety of suitable methods and/or techniques may be utilized to bond the tapes together, for example, adhesives, ultrasonic welding, or mechanical fasteners.

At block 1115, a longitudinally extending fold may be formed in each of the tapes. In this regard, each tape may form two respective prongs of a separator. In certain embodiments, the tapes may be folded after being bonded together. In other embodiments, the tapes may be folded after being bonded together. In yet other embodiments, the tapes may be folded without being bonded together.

At block 1120, the tapes may be positioned between a plurality of twisted pairs. For example, a separator structure or separator formed by the tapes may be positioned between a plurality of twisted pairs, and respective prongs of the separator may extend between adjacent sets of twisted pairs.

In certain embodiments, one or more prongs of separator may extend beyond an outer periphery of the twisted pairs. At block 1125, which may be optional in certain embodiments, one or more extending portions or ends of the tapes may be wrapped or curled around the outer periphery of the twisted pairs. In this regard, a complete or partial outer shield may be formed around the twisted pairs. Additionally, in certain embodiments, one or more overlapping portions may be formed by the tape portions that are wrapped around the twisted pairs. At block 1130, one or more overlapping portions may optionally be bonded or joined to an underlying portion, such as another extending portion, etc.

At block 1135, one or more finishing operations may be performed with respect to the twisted pair component that includes the twisted pairs and the separator. A wide variety of suitable finishing operations may be performed as desired in various embodiments. For example, at block 1140, the twisted pair component may be taken up or collected for subsequent incorporation into a cable. As another example, at block 1145, a suitable jacket layer or binder may be formed around the twisted pair component. As yet another example, the twisted pair component may be provided downstream to a suitable component or system that incorporates the twisted pair structure into a cable.

As desired in various embodiments, the method 1100 may include more or less operations than those described above with reference to FIG. 11. Additionally, in certain embodiments, any number of the described operations may be carried out or performed in parallel. The described method 1100 is provided by way of non-limiting example only.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A cable comprising four twisted pairs of individually insulated electrical conductors that extend along a longitudinal direction;

a separator positioned between the twisted pairs, the separator comprising only two tape structures, wherein:

a first of the two tape structures comprises electromagnetic shielding material and has a first width in a width dimension perpendicular to the longitudinal direction, a first longitudinally extending widthwise edge, and a second longitudinally extending widthwise edge opposite the first edge; and a second of the two tape structures comprises electromagnetic shielding material and has a second width in the width dimension, a third longitudinally extending widthwise edge, and a fourth longitudinally extending widthwise edge opposite the third edge, the first tape structure and the second tape structure are bonded together along a longitudinally extending line positioned between the first and second edges of the first tape structure and between the third and fourth edges of the second tape structure, the first tape structure extends from the longitudinally extending line in a first direction between a first and a second of the four twisted pairs and in a second direction between the first and a third of the four twisted pairs without extending between the second and a fourth of the four twisted pairs or between the third and a fourth of the four twisted pairs, and the second tape structure extends from the longitudinally extending line in a third direction between the second and the fourth of the four twisted pairs and in a fourth direction between the third and the fourth of the four twisted pairs without extending between the first and the second of the four twisted pairs or between the first and the third of the four twisted pairs; and a jacket formed around the twisted pairs and the separator.

2. The cable of claim 1, wherein the first tape structure comprises a first longitudinally extending fold, the second tape structure comprises a second longitudinally extending fold, and the longitudinally extending line is proximate to the first and second longitudinally extending folds.

3. The cable of claim 1, wherein the first tape structure and the second tape structure each comprise a base layer of dielectric material and a layer of electrically conductive material formed on the base layer.

4. The cable of claim 3, wherein the layer of electrically conductive material comprises a plurality of discontinuous patches of electrically conductive material.

5. The cable of claim 1, wherein the first and second tape structures comprise substantially flat tape structures.

6. The cable of claim 1, wherein at least one of the first tape structure or the second tape structure is further wrapped around an outer periphery of the four twisted pairs.

7. The cable of claim 6, wherein both the first and second tape structures are wrapped around the outer periphery such that each of the widthwise edges contacts one of the first or second tape structure.

8. A cable comprising:

a plurality of twisted pairs of individually insulated conductors;

a separator positioned between the plurality of twisted pairs, the separator comprising:

a first longitudinally extending tape structure comprising electromagnetic shielding material and having a first longitudinal fold between its widthwise edges; and a second longitudinally extending tape structure comprising electromagnetic shielding material and having a second longitudinal fold between its widthwise edges, wherein the first tape structure and the second tape structure are bonded together only along a longitudinally extending line positioned between the plurality of twisted pairs and proximate to the first and second longitudinal folds; and a jacket formed around the plurality of twisted pairs and the separator.

9. The cable of claim 8, wherein the first tape structure extends from the longitudinally extending bonding line between a first and second set of adjacent twisted pairs and the second tape structure extends from the longitudinally extending bonding line between a third and fourth set of adjacent twisted pairs.

10. The cable of claim 8, wherein the separator comprises an approximately cross-shaped cross-section.

11. The cable of claim 8, wherein the first tape structure and the second tape structure each comprise a base layer of dielectric material and a layer of electrically conductive material formed on the base layer.

12. The cable of claim 11, wherein the layer of electrically conductive material comprises a plurality of discontinuous patches of electrically conductive material.

13. The cable of claim 8, wherein at least one of the first tape structure or the second tape structure is further wrapped around an outer periphery of the plurality of twisted pairs.

14. The cable of claim 13, wherein both the first and second tape structures are wrapped around the outer periphery such that each of the widthwise edges contacts one of the first or second tape structure.

15. A cable comprising:

a plurality of twisted pairs of individually insulated conductors;

a separator positioned between the plurality of twisted pairs and having an approximately cross-shaped cross-section, the separator comprising:

two tape structures that are longitudinally bonded together only at a position between the plurality of twisted pairs, wherein each tape structure comprises electromagnetic shielding material and extends from the bonding position between two respective sets of twisted pairs.

16. The cable of claim 15, wherein each of the tape structures comprises a longitudinally extending fold positioned proximate to a line along which the two tape structures are bonded together.

17. The cable of claim 15, wherein each of the tape structures comprise a base layer of dielectric material and a layer of electrically conductive material formed on the base layer.

18. The cable of claim 17, wherein the layer of electrically conductive material comprises a plurality of discontinuous patches of electrically conductive material.

19. The cable of claim 15, wherein at least one of the two tape structures is further wrapped around an outer periphery of the plurality of twisted pairs.

20. The cable of claim 19, wherein both of the tape structures are wrapped around the outer periphery such that each of their respective widthwise edges contacts one of the two tape structures.

* * * * *